US008769746B2

(12) United States Patent
Abadi

(10) Patent No.: US 8,769,746 B2
(45) Date of Patent: Jul. 8, 2014

(54) SUPPORT SURFACE ASSEMBLY AND TENSIONING METHOD FOR A SLEEPING PERSON

(75) Inventor: Shlomo Abadi, Pardes Hana (IL)

(73) Assignee: Airnettress Ltd., Tel Aviv (IL)

( * ) Notice: Subject to any disclaimer, the term of this patent is extended or adjusted under 35 U.S.C. 154(b) by 401 days.

(21) Appl. No.: 13/009,871

(22) Filed: Jan. 20, 2011

(65) Prior Publication Data

US 2011/0167565 A1 Jul. 14, 2011

Related U.S. Application Data

(63) Continuation-in-part of application No. 12/364,319, filed on Feb. 2, 2009, now abandoned, which is a continuation-in-part of application No. PCT/IL2007/000976, filed on Aug. 6, 2007.

(30) Foreign Application Priority Data

Aug. 7, 2006 (IL) ..... 177343
Apr. 16, 2007 (IL) ..... 182576

(51) Int. Cl.
*A47D 7/00* (2006.01)

(52) U.S. Cl.
USPC ..... 5/655; 5/110; 5/200.1; 5/302; 5/652.1; 5/724; 5/739

(58) Field of Classification Search
USPC ..... 5/603, 630, 632, 638, 643, 110, 200.1, 5/211, 230, 232, 286, 288, 302, 303, 724, 5/739, 652, 652.1, 655, 98.3, 114, 187, 5/197, 201, 202; 4/571.1–573.1; 297/284.2, 452.13; 600/534, 959
See application file for complete search history.

(56) References Cited

U.S. PATENT DOCUMENTS

| | | | |
|---|---|---|---|
| 128,504 | A | 7/1872 | Peters |
| 663,692 | A | 12/1900 | Brand |
| 1,173,744 | A | 2/1916 | Rukes |
| 1,319,658 | A | 10/1919 | Schulte |

(Continued)

FOREIGN PATENT DOCUMENTS

| | | |
|---|---|---|
| AU | 642603 | 3/1993 |
| DE | 339421 | 7/1921 |

(Continued)

OTHER PUBLICATIONS

International Search Report, Application No. PCT/IL2007/000976 Aug. 27, 2008. (3 pages).

(Continued)

*Primary Examiner* — Nicholas Polito
(74) *Attorney, Agent, or Firm* — Dorsey & Whitney LLP

(57) ABSTRACT

A support surface assembly for a sleeping person that comprises a rigid frame with an upper edge for supporting an air-permeable layer and an air-permeable layer that is fixedly joined to the upper edge in a desired tension, such that the upper edge is entirely covered by the outer perimeter of the air-permeable layer. The air-permeable layer comprises a lattice grid structure such as a mesh material, a netting or a web-like material. The outer perimeter of the air-permeable layer is joined to the frame at the side wall or at the bottom wall of the frame.

21 Claims, 34 Drawing Sheets

(56) References Cited

U.S. PATENT DOCUMENTS

| | | | | |
|---|---|---|---|---|
| 1,748,010 | A | 2/1930 | Rusha et al. | |
| 1,944,064 | A | 1/1934 | Byer | |
| 2,600,240 | A | 6/1952 | Grieb | |
| 3,076,451 | A | 2/1963 | Stoner | |
| 3,335,713 | A | 8/1967 | Grosholz et al. | |
| 4,146,885 | A | 3/1979 | Lawson, Jr. | |
| 4,657,025 | A * | 4/1987 | Orlando | 600/484 |
| 4,657,026 | A | 4/1987 | Tagg | |
| 4,730,604 | A | 3/1988 | Boggs | |
| 5,317,767 | A | 6/1994 | Hargest et al. | |
| 5,360,258 | A | 11/1994 | Alivizatos | |
| 5,396,674 | A | 3/1995 | Bolds | |
| 5,561,876 | A | 10/1996 | Petruzella | |
| 5,664,273 | A | 9/1997 | Obriot | |
| 5,699,571 | A | 12/1997 | Yowell | |
| 5,855,031 | A | 1/1999 | Swift, Jr. | |
| 5,857,232 | A | 1/1999 | Mahdavi | |
| 5,887,304 | A | 3/1999 | Von der Heyde | |
| 5,992,348 | A * | 11/1999 | Harding | 119/28.5 |
| 6,026,525 | A | 2/2000 | Davis | |
| 6,074,340 | A | 6/2000 | Sweeney et al. | |
| 6,131,216 | A | 10/2000 | Pine | |
| 6,199,234 | B1 | 3/2001 | Srour et al. | |
| 6,256,813 | B1 | 7/2001 | Aaron | |
| 6,336,237 | B1 | 1/2002 | Schmid | |
| 6,513,178 | B1 * | 2/2003 | Kelly et al. | 5/110 |
| 7,127,763 | B1 | 10/2006 | Schmid et al. | |
| 2003/0070232 | A1 | 4/2003 | Diak/Ghanem | |
| 2004/0261174 | A1 | 12/2004 | DeHart et al. | |
| 2007/0011813 | A1 | 1/2007 | Rathle | |
| 2009/0211022 | A1 | 8/2009 | Harding | |
| 2009/0241264 | A1 | 10/2009 | Bensoussan | |
| 2010/0275379 | A1 | 11/2010 | Streightiff | |

FOREIGN PATENT DOCUMENTS

| | | |
|---|---|---|
| EP | 0852472 | 7/1998 |
| GB | 190914449 | 3/1910 |
| GB | 1501281 | 2/1978 |
| GB | 1579867 | 11/1980 |
| GB | 2095541 | 10/1982 |
| GB | 2264050 | 8/1993 |
| GB | 2320182 | 6/1998 |
| JP | 11076324 | 3/1990 |
| JP | H10248679 | 9/1998 |
| JP | 2006263092 | 10/2006 |
| WO | WO0143597 | 6/2001 |
| WO | WO2006108540 | 10/2006 |

OTHER PUBLICATIONS

Merriam Webster definition of the word fabric) (1 page) (available as of Aug. 12, 2011).

Merriam Webster definition of the word "mesh" (1 page) (available as of Aug. 12, 2011).

International Search Report from International Application No. PCT/IL2012/050015 mailed Jun. 19, 2012.

* cited by examiner

| Mattress | Exposure (days) | Estimated No. mites | No. living mites | Average |
|---|---|---|---|---|
| I | 2 | (+) | | |
| J | 2 | + | | |
| K | 2 | (+) | | |
| Control (C) | 2 | ++ | | |
| I | 4 | (+) | | |
| J | 4 | (+) | | |
| K | 4 | (+) | | |
| Control (C) | 4 | ++ | | |
| I | 7 | | 20 | |
| J | 7 | | 27 | 26.3 |
| K | 7 | | 32 | |
| Control (C) | 7 | | 490 | |

SUPPORT SURFACE ASSEMBLY AND TENSIONING METHOD FOR A SLEEPING PERSON

This application is a Continuation-In-Part of U.S. Ser. No. 12/364,319 (filed Feb. 2, 2009), which is a Continuation-In-Part of PCT/IL2007/000976 (filed on Aug. 6, 2007), which is derived from IL 177343 (filed on Aug. 7, 2006) and from IL 182576 (filed on Apr. 16, 2007).

FIELD OF THE INVENTION

The present invention relates in general to the field of sleeping surfaces. In particular, the present invention relates to a support surface assembly for sleeping persons. More particularly, the present invention relates to an air-permeable support surface assembly to allow a person to breathe naturally and without obstruction while sleeping thereon and to a method for tensioning the surface.

BACKGROUND OF THE INVENTION

Sleep is considered to be a time of growth and rejuvenation for organisms. Teenagers and adults typically sleep between 6-8 hours per night, while children and the elderly often require more sleep and thus spend more time in bed. It is therefore important that the surface that one sleeps on, no matter what one's age, does not pose any risks for any health or physical harm.

One of the many aspects of infant care includes the position in which an infant should sleep. Based on current research, parents are advised to place a sleeping infant in a supine (face-up) position, as opposed to a prone (face-down) position, due to the possible risks involved with prone sleeping. These risks include suffocation, which may occur if air (oxygen) flow to the infant is obstructed. Such an incident is more likely when the infant is positioned in a manner wherein its mouth and nose are in close contact with or are enveloped by a soft mattress or a mattress cover. Similarly, in a prone position, the infant may breathe into a small unventilated space, so that it may inhale exhaled carbon dioxide for an extended period of time, which in a subset of infants can lead to asphyxiation and death.

Although the sleeping infant may be positioned in its crib or bed in a supine position, when the infant is strong enough to turn over by itself, it may change on its own to a prone position. In many cases, an infant may be strong enough to turn from a supine to prone position, but not the reverse. Thus, if an adult does not notice that the infant has turned over, the infant may remain in the prone position for an entire night.

It is therefore important that the surface upon which an infant sleeps is air-permeable to allow the infant to breathe naturally and fully without obstruction, even in a prone position.

The American Academy of Pediatrics [www.aap.org] discloses that a firm mattress is helpful in preventing sudden infant death syndrome (SIDS) and in promoting child development.

There have been various attempts by the prior art to overcome to problems associated with sleeping infants; however, they each have drawbacks or difficulties of their own.

U.S. Pat. No. 5,664,273 discloses a mattress assembly for supporting a sleeping infant or child. The assembly comprises a frame member and a mattress cover supported in tension over the frame member. The frame member has an open box-like structure with wide legs and side walls. The side walls comprise recessed portions for allowing some air-flow to transfer between the surroundings and the bottom of the mattress cover. The frame member is typically made of a rigid or semi-rigid material. The assembly disclosed in U.S. Pat. No. 5,664,273 is essentially an entire bed structure for replacing a conventional bed. The structure is bulky, and, depending on the material of the frame may be weighty and difficult to transport and store. Additionally, when the infant soils the mattress cover, the mattress cover must be removed and cleaned before refastening. This process can be very tedious, depending on the fastening arrangement used and on the dexterity of the adult who performs the removing and refastening, especially when soiling occurs frequently.

It is important to note that although U.S. Pat. No. 5,664,273 attempts to provide an unblocked passage for air flow, due to the thick side wrap portions, air flow between the surroundings and the bottom of the mattress cover is somewhat restricted. Thus, since the frame member is comprised of a substantial thickness, the infant may move its body to the frame area while it is sleeping, which can result in suffocation or asphyxiation, as described herein above.

An additional risk associated with infant care, in particular, with reference to U.S. Pat. No. 5,664,273, includes potential injury to the infant. The frame member of U.S. Pat. No. 5,664,273 is made of a hard material, and comprises a substantial thickness. Thus, if an infant accidentally falls or moves abruptly when situated on the bed, it might bang its head or other body part on the frame. In some cases, this may cause the infant to grow a bump, and in more severe cases, bleeding, or even a concussion may occur.

Furthermore, as the child grows in size (weight and height), the mattress cover of U.S. Pat. No. 5,664,273 will undergo a sinking (or, sagging) effect over time. Since the fastening means is rigid, there is no solution to this problem except to purchase a new mattress cover to replace the old one.

Other air permeable sleeping surfaces for infants are disclosed in U.S. Pat. No. 6,026,525, U.S. Pat. No. 6,256,813, and [http://cgi.ebay.com/Natural-Airflow-baby-mattress-infant-crib-cradle-safely]. These sleeping surfaces, however, are liable to sag. The latter publication, for example, comprises a plurality of straps located on the back of the mattress for adjusting the surface tension. As the straps are not adapted to be fixated and the material from which the surface is made does not have a large load bearing capacity, the sleeping surface tends to sag when a load is placed thereon. If the straps are subjected to an excessive tensile force, they are liable to be severed from the sleeping surface.

In addition to the importance of the structure of the sleeping surface of an infant as described above, the structure of the surface on which an older child or an adult sleeps will often have an affect on the health of the person.

Recently, an increase in the prevalence of asthma, nasal allergies and eczema has been observed particularly in industrialized countries. These maladies are frequently exacerbated by dust mites, pollen, hair shed from house pets, etc. Dust mites, flourish in areas where dust accumulates in the home, especially in moist and humid conditions, such as found on and below mattresses and within carpets. The mites nourish on flakes of skin that are shed from the body, and they attach themselves to the textile fibers of the mattress and carpet. Often, their attachment to these fibers is so strong that even the suction force from a standard vacuum cleaner is not strong enough to remove the mites.

Children in particular are exposed to high levels of dust mites for long periods of time and therefore suffer more than adults from symptoms related to this exposure. A study published in the New England Journal of Medicine in September, 2004, showed that improvement in allergy and asthma related afflictions occurred when measures were taken to remove dust mites from the home. 937 children between the ages of 5-11, with moderate to severe asthma were examined. The families of these children were given anti-allergenic items, such as mattress covers, special vacuum cleaners and air filters for use in their homes. The results indicated a significant decrease in asthma symptoms for these children, including fewer nocturnal awakenings, fewer absences from school and fewer stays in the hospital. The latest international guidelines on asthma have emphasized the importance of prevention of exposure to asthma triggers within the home in general, and especially to dust mites.

As indicated above, mattress covers made of a unique material that seal in the dust mites exist and are intended to prevent the sleeping person from breathing in the mites during sleep. However, such covers are uncomfortable for the user to sleep on, are expensive to purchase and need to be changed regularly. Other preventative measures include unique vacuum cleaners and air filters, which are often costly as well, and extermination spray, which may be hazardous to one's health and not efficient.

It is therefore an object of the present invention to provide a support surface that allows a person to remain in a healthy state while sleeping thereon.

It is an additional object of the present invention to provide a support surface that allows air flow to pass through.

It is an additional object of the present invention to provide a support surface assembly comprising an air permeable layer.

It is an additional object of the present invention to provide a support surface assembly for a sleeping infant, which reduces the risk of injury to an infant that falls on it.

It is an additional object of the present invention to provide a support surface assembly that is easy to transport and may be collapsed and stored easily.

It is an additional object of the present invention to provide a support surface assembly which is easily cleanable.

It is an additional object of the present invention to provide a support surface assembly that prevents the accumulation of dust mites on it.

It is an additional object of the present invention to provide a support surface assembly that prevents sagging of the air-permeable layer.

Additional objects and advantages of the present invention will become apparent as the description proceeds.

SUMMARY OF THE INVENTION

The present invention relates to a support surface assembly for a sleeping person. The assembly includes four corner elements, four elongated, rigid frame sections defining a rectangular perimeter of the support surface assembly, and an air-permeable layer suspended on the upper edge of the frame sections. A plurality of peripheral portions are attached to the air-permeable layer. Each of the frame sections is provided with an upper edge, inner wall, and outer wall. Two adjacent and substantially mutually perpendicular frame sections are pivotally connected to a common corner element.

Each peripheral portion of the air-permeable layer is received and secured by means of a pressure fit in a groove formed in the inner wall of a corresponding frame section. A frame contactable portion of the air-permeable layer is wrapped about the corresponding frame section upon application of a moment to each of the corresponding frame sections, tensioning the air-permeable layer and causing the corresponding frame sections to be coupled with two adjacent corner elements.

The peripheral portion is preferably attached to the air-permeable layer and includes a loop for receiving via an opening in the cover member a rod securable to walls of the groove.

The air-permeable layer is preferably a screenprinting mesh and is fatigue resistant during 2000 pressure applications thereon at a level of 10 N/100 $cm^2$.

In one aspect, the corner element has a convex outer wall and an arcuate inner wall both of which subtending an angle of approximately 90 degrees. Two straight interface elements extend between the outer wall and the inner wall at each terminal end thereof. Two apertures are bored in each of the interface elements by which a corresponding frame section is coupled with the corner element. The corner element may be provided with an interspace between the inner and outer walls through which attachment elements for immobilizing the corner element by means of a fixation device and for attachment to an underlying work surface pass.

In one aspect, the support surface assembly further includes a decorative shield contactable with, and securable to, the outer wall of the corner element. The outer wall of an adjacent frame section is substantially flush with the shield after being pivoted to an upright position.

In one aspect, the frame section has a cover member with a planar plate at each of its two longitudinal ends facing an adjacent corner element, an axle by which the frame section pivots and a spring biased pin protruding from the cover member for engaging the two apertures, respectively, bored in an adjacent interface element of the corner element.

In one aspect, the groove in which the peripheral portion of the air-permeable layer is received is a longitudinally extending groove that separates the inner wall of the frame section into an upper inner wall and a lower inner wall. The upper wall is oblique with respect to the outer wall such that the width of the upper edge which extends between the outer wall and upper inner wall is considerably less than the width of the bottom wall.

In one aspect, the frame section has a planar outer wall and a bottom wall substantially perpendicular to the outer wall and the lower inner wall, the bottom wall being provided with two opposed rounded portions extending to the outer wall and the lower inner wall, respectively.

In one aspect, vibratory motion of the air-permeable layer is transmitted to a movement sensor placed on a frame support by means of a vibration transmitter. The vibration transmitter includes an upper member in contact with an underside of the air-permeable layer, a lower member in contact with the movement sensor and coupled to the upper member, and spring means extending from the lower member to a surface of the upper member. The lower member oscillates in response to the vibratory motion, inducing a corresponding electrical signal by means of the movement sensor.

In one aspect, the support surface assembly further includes a plurality of pivotable legs for elevating one longitudinal end of the frame.

In one aspect, a final length of the air-permeable layer stretched over a distance between groove centers after pivoting the frame sections is 1-4% longer than the initial length before pivoting.

In one aspect, a ratio of fiber to area ratio of the air-permeable layer is between 40% and 60%, preferably between 45% and 55%.

The present invention is also directed to a method for tensioning an air-permeable layer that is suspended on a plurality of frame sections. The method includes the steps of:

a) Providing four elongated, rigid frame sections, each of the frame sections having an upper edge, an inner wall, a longitudinal groove formed in an intermediate portion of the inner wall, a bottom wall, and an outer wall, and having at each longitudinal end thereof a cover member with a planar plate substantially perpendicular to the outer wall from which protrude an axle and a spring biased pin.

b) Providing four corner elements, each of which having an upper edge, an outer wall, an inner wall, and two straight interface elements extending between the outer wall and the inner wall at each terminal end thereof, wherein upper and lower apertures are bored in each of the interface elements.

c) Placing the upper edge of each of the four corner elements on a substantially rectangular air-permeable layer, a straight peripheral portion provided with a loop being attached to each end of the air-permeable layer.

d) Coupling each of the frame sections with two of the corner elements by rotatably mounting the axle protruding from a first frame section longitudinal end within the upper aperture of a corresponding interface element of a first corner element and rotatably mounting the axle protruding from a second frame section longitudinal end within the upper aperture of a corresponding interface element of a second corner element until the four frame sections are in a pre-tensioning position such that their outer wall contacts the air-permeable layer and first and second frame sections are substantially mutually parallel and third and fourth frame sections are substantially perpendicular to the first and second frame sections.

e) Inserting each of the peripheral portions in the groove of a corresponding frame section;

f) Feeding a rod into each peripheral portion loop via an opening in a corresponding cover member which is in communication with the groove, whereby to secure a peripheral portion to corresponding walls of the groove;

g) Immobilizing the four corner elements;

h) Pivoting each of the frame sections about its two axles, causing a frame contactable portion of the air-permeable layer to be partially wrapped about the bottom wall and inner wall of a corresponding frame section and a sleeping surface of the air-permeable layer to be additionally tensioned; and i) Causing the pins protruding from the first and second frame section longitudinal ends, respectively, to be received within the lower aperture of the corresponding interface element of the first and second corner elements, respectively, so that the frame sections will assume an upright position.

In one aspect, two or more of the frame sections are concurrently pivoted.

In one aspect, a corner element is immobilized by coupling a fixation device thereto and attaching the fixation device to an underlying work surface.

In one aspect, each of the frame sections is pivoted by means of a corresponding arm assembly, the arm assembly comprising a plurality of differently oriented arms connected to a roller assembly in which are rotatably mounted three rollers that rollingly contact the outer wall, bottom wall, and inner wall, respectively, of the frame section.

In one aspect, a controller selectively controls the rate of pivoting of each of the arm assemblies to ensure that the sleeping surface of the air-permeable layer will be tensioned to a substantially uniform level.

DETAILED DESCRIPTION OF PREFERRED EMBODIMENTS

The average person spends between six to eight hours sleeping, out of a twenty-four hour day. Children and the elderly often spend even more time sleeping. It is therefore important that the construction of the mattress that one sleeps on is conducive to one's health. The present invention is concerned with providing a sleeping surface that can benefit people of all ages.

With regard to infants, it is important for an infant to be able to breathe naturally and without obstruction at all times while sleeping. Conventional mattresses are typically air-impermeable, which, therefore, blocks air flow to an infant who is sleeping in a face down position. This may cause the infant to stop breathing due to physical suffocation or by rebreathing of $CO_2$ which may ultimately result in death. The present invention solves this problem by providing an air-permeable surface on which an infant may sleep, which enables air flow even when sleeping in a face down position. Additionally, the air-permeable surface of the present invention is constructed such that the risk of injury due to collision with a rigid frame is reduced to almost zero.

Figure 1:
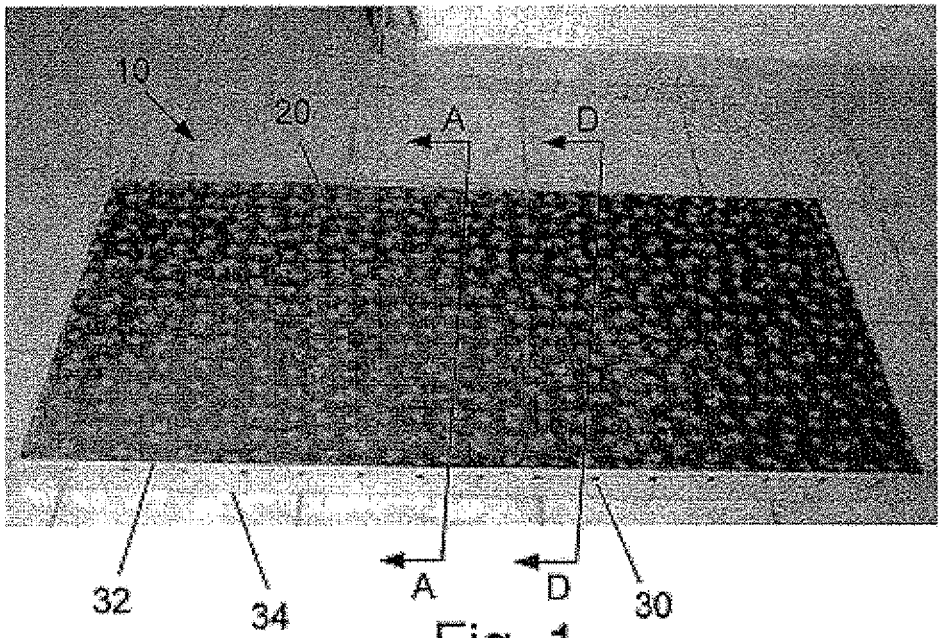
FIG. 1 illustrates the first embodiment of the present invention in a top perspective view.
Figure 2:
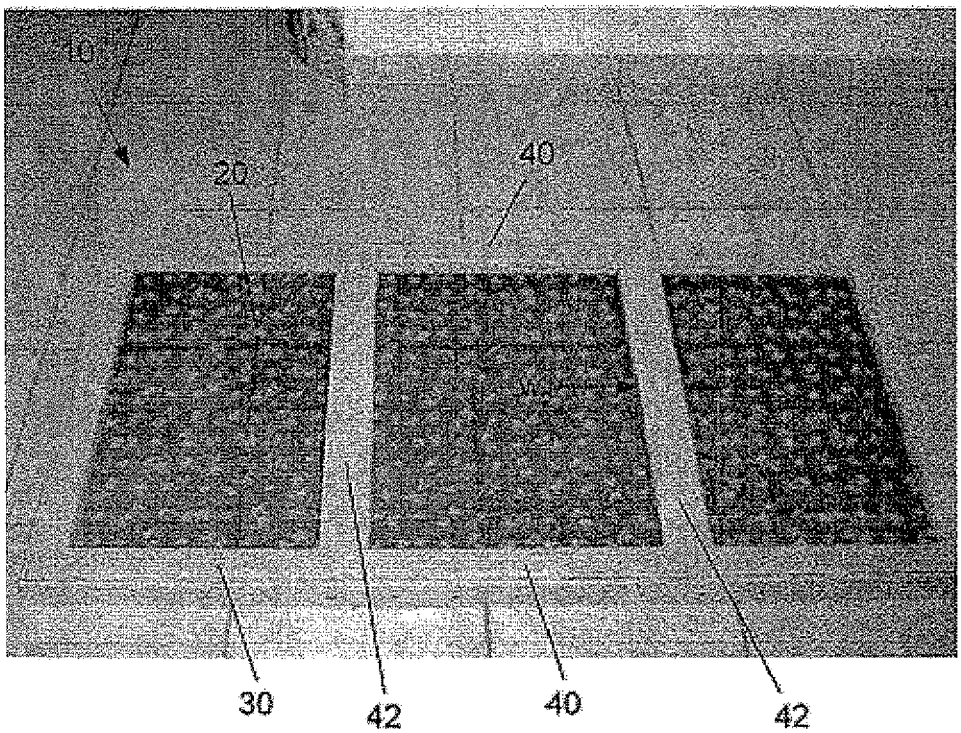
FIG. 2 illustrates the first embodiment of the present invention in a bottom perspective view.

A first embodiment of the support surface assembly of the present invention, shown in a top perspective view in FIG. 1 and a bottom perspective view in FIG. 2, and designated generally by the numeral (10), comprises an air-permeable layer (20) and a rigid frame (30) for supporting air-permeable layer (20).

Air-permeable layer (20) comprises a lattice grid (e.g., mesh, netting, web-like, etc.) structure, having a predetermined grid density. Layer (20) is made of a sturdy material, for instance, nylon, polyester or metallic wire. Although not shown in FIGS. 1 and 2, the outer perimeter of layer (20) preferably extends past the upper edge (32) of frame (30) and around the side wall (34) of frame (30), as shown and described in FIG. 3 herein below.

The degree of firmness as well as the elasticity of layer (20) is determined based on factors including the density of the grid, the hardness or softness of the material of layer (20) and the tautness of layer (20) (i.e., how tightly layer (20) is pulled over the upper edge (32) of frame (30)). These parameters are typically determined prior to manufacturing. Preferably, layer (20) is made of a soft, light weight material that provides an ergonomic and comfortable feel to the person lying thereon.

Figure 3:
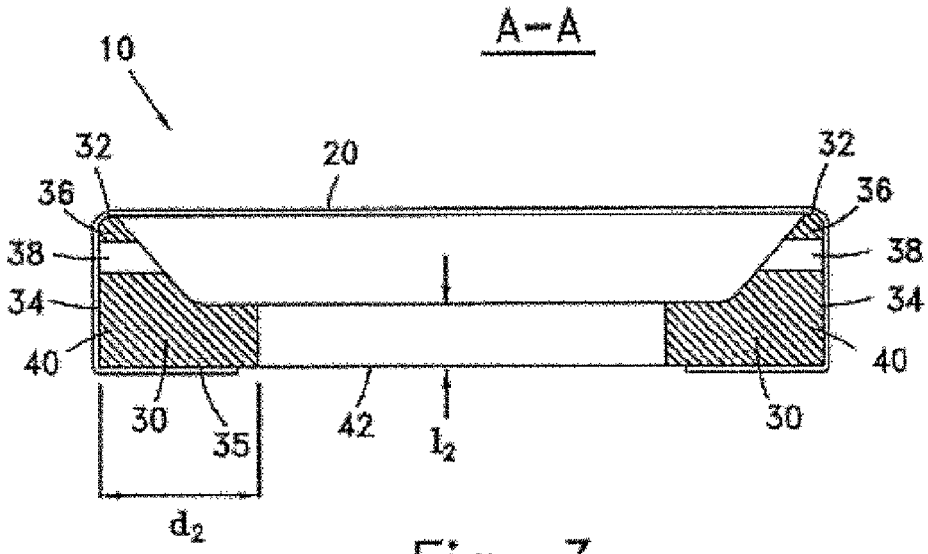
FIG. 3 illustrates a schematic cross-sectional view of the first embodiment of the present invention taken along A-A of FIG. 1.

FIG. 3 shows a schematic cross-sectional view of the first embodiment of support surface assembly (10) of the present invention taken along A-A of FIG. 1. Frame (30) comprises an upper portion (36) having a substantially triangular cross-section, and a lower portion (40) having a substantially rectangular cross-section. Upper and lower portions (36), (40) are preferably a single integral unit, but alternatively may be made of more than one element.

As described herein above, layer (20) is preferably wrapped around side wall (34) and is fixedly joined to frame (30) at bottom wall (35) by means known in the art, for instance, hot or cold welding, or by providing adhesive material at the interfacing surfaces. Alternatively, layer (20) is fixedly joined to frame (30) at side wall (34) or at the upper edge of frame (30) (not shown in the figures). When joining layer (20) to frame (30) at bottom wall (35) (or even at side wall (34)), the adhesive material for joining layer (20) to frame (30), is non-harmful and non-toxic, and is safely distanced from the infant's mouth or nose. Therefore, even if the infant sleeps directly above the upper edge (32), there is little danger of the infant accidentally ingesting the adhesive material.

Frame (30) is made of any rigid material, for instance, metal, wood, hard plastic, etc. Upper edge (32) is preferably rounded, and may have any diameter (thickness), but preferably has a diameter of between 0.5-5 mm, more preferably, between 2-3 mm. The rounded configuration provides a safer environment than a cornered configuration, particularly for an infant who may fall and bang his head or other body part on upper edge (32), as described herein above. Optionally, upper edge (32) may be covered by a padding, such as foam or soft plastic. Moreover, even if the infant does fall in the area of frame (30), it is likely that the infant will not fall directly on rigid frame (30) due to the relatively thin upper edge (32).

Figure 4:
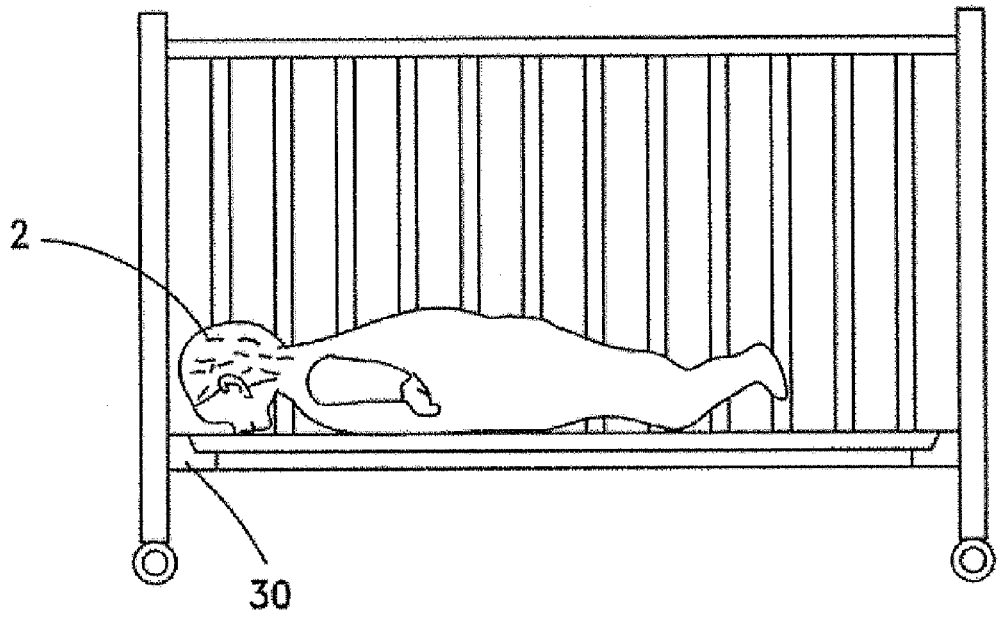
FIG. 4 illustrates a cross-sectional view of an infant sleeping in a bed on the support surface assembly of the present invention.

As shown in FIG. 4, due to the geometrical configuration of frame (30), as well as the shape of the human head (2) even when the mouth of the sleeping infant may be pressed against, or in close proximity to frame (30), unobstructed air flow is possible.

Referring again to FIG. 3, upper portion (36) preferably comprises a plurality of passageways (38), thereby providing additional means to allow air flow to reach an infant that is sleeping with its mouth pressed against, or in close proximity to frame (30). Although passageways (38) are shown in the figures situated at upper portion (36) of frame (30), it is understood that they may be alternatively, or additionally be situated at lower portion (40), mutatis mutandis.

Preferably, transverse cross bars (42) (FIG. 2 and FIG. 3) extend between opposing lower portions (40) of frame (30) for providing support to frame (30). Although two cross bars (42) are shown in the embodiment herein (FIG. 2), the number of bars and the thickness of each cross bar (42) may vary according to factors such as the dimensions of frame (30) and the weight of the infant.

Cleaning of support surface assembly (10) may be accomplished by conventional means such as by wiping layer (20) and frame (30) with a rag and/or cleaning fluid. Alternatively, support surface assembly (10) may be soaked in a tub or pool of cleaning fluid for a predetermined amount of time. A preferred method of cleaning support surface assembly (10) is by spraying warm or hot water by, for instance, with the aid of a shower head. A conventional mattress is much more difficult to clean, and may not be washed or soaked as described above. A vacuum cleaner may be used for cleaning a conventional mattress; however, inevitably, not all of the dirt is removed. The present invention allows a thorough cleaning of support surface assembly (10), which essentially completely rids support surface assembly (10) of bacteria, dust mites and dirt. Additionally, due to the lattice grid structure of the sleeping surface of the present invention it prevents dust and bacteria accumulation thereby creating a clean and mite-free sleeping surface (10), particularly in comparison to a conventional mattress. This is especially advantageous for infants suffering from allergies.

Figure 5:
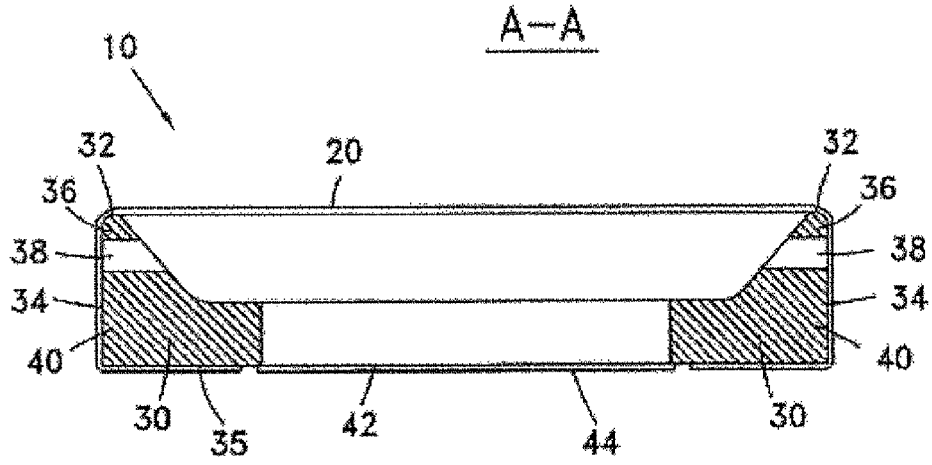
FIG. 5 illustrates the view of FIG. 3, wherein a breathing and movement monitor is situated below the present invention.

Optionally, as shown in a schematic cross-sectional view in FIG. 5, mutatis mutandis, a respiratory movement sensor (44) is positioned below cross bars (42).

According to another embodiment, a respiratory movement sensor may be attached to the air-permeable layer (20), in order to sense mechanical vibrations resulting from breathing. The sensor transmits signals that represent the profile or pattern of the sensed vibrations to a monitoring device, which analyzes them and compares them to a reference profile or pattern that corresponds to a normal respiratory state of the infant. Whenever the sensed profile or pattern deviates from a predetermined threshold, the monitoring device will issue an alarm or noticeable signal (which can be visual, audible, mechanical etc.).

Figure 23:
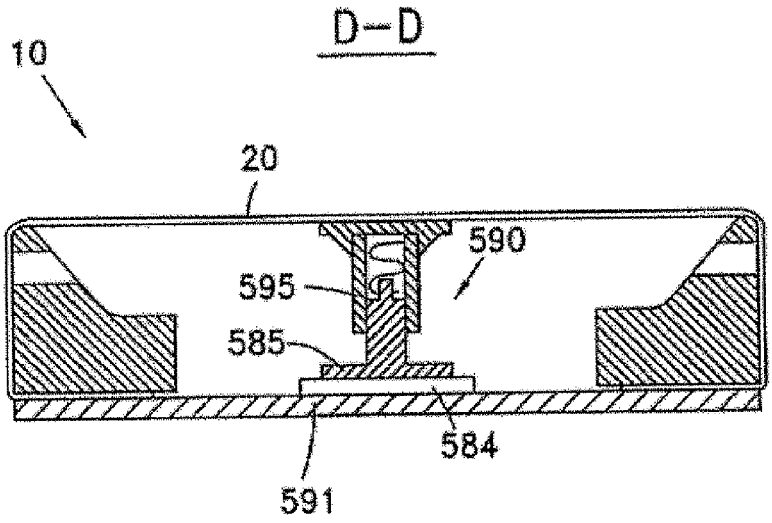
FIG. 23 illustrates a cross-sectional view of another embodiment of the present invention taken along D-D of FIG. 1, showing a vibration transmitter that interfaces between an air permeable layer and a movement sensor.

In the embodiment of FIG. 23, a movement sensor (584), such as one provided with a piezoelectric transducer for sensing movement including breathing patterns of the sleeping person, is placed on frame support (591) of the bed. A vibration transmitter (590) is positioned between air permeable layer (20) of assembly (10) and movement sensor (584).

A movement sensor (584) has generally been placed heretofore underneath the mattress of the sleeping person, resulting in a significant attenuation of the received signal by the mattress material and a faulty alarm signal being generated. As a result of the attenuation of the received signal, more serious problems can arise, such as a parent not being alerted during a life threatening condition of an infant, e.g. an apnea event.

Since vibration transmitter (590) interfaces between air permeable layer (20) and movement sensor (584), the vibratory movement of air permeable layer (20) resulting from the movement of the sleeping person will be directly transmitted to movement sensor (584), thereby preventing significant attenuation of the received signal.

Figure 24:
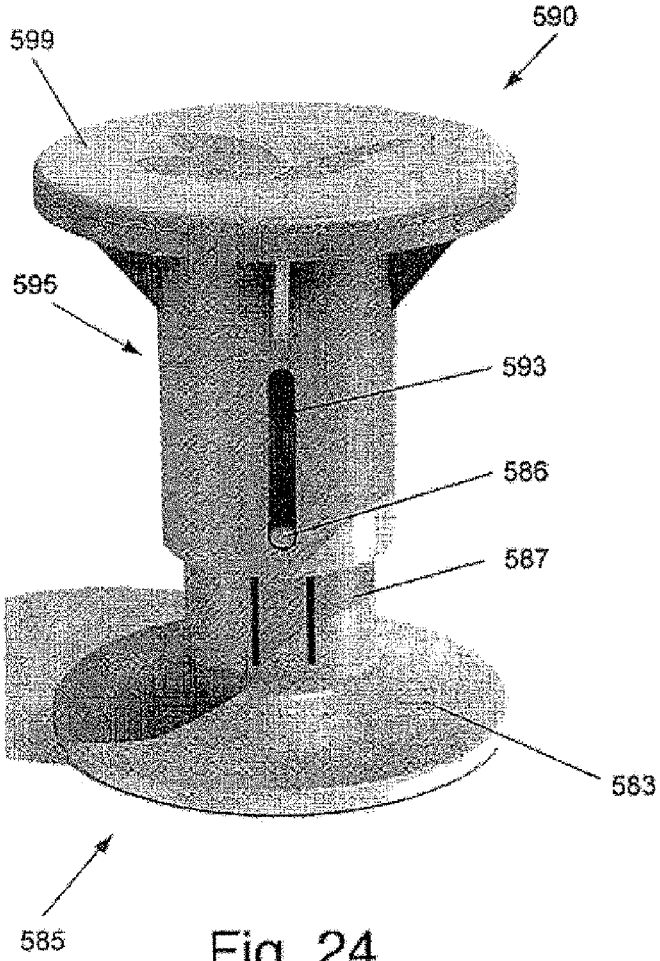
FIG. 24 illustrates a perspective view of the vibration transmitter of FIG. 23, showing an upper member thereof in an uppermost position when coupled to the lower member thereof.
Figure 25:
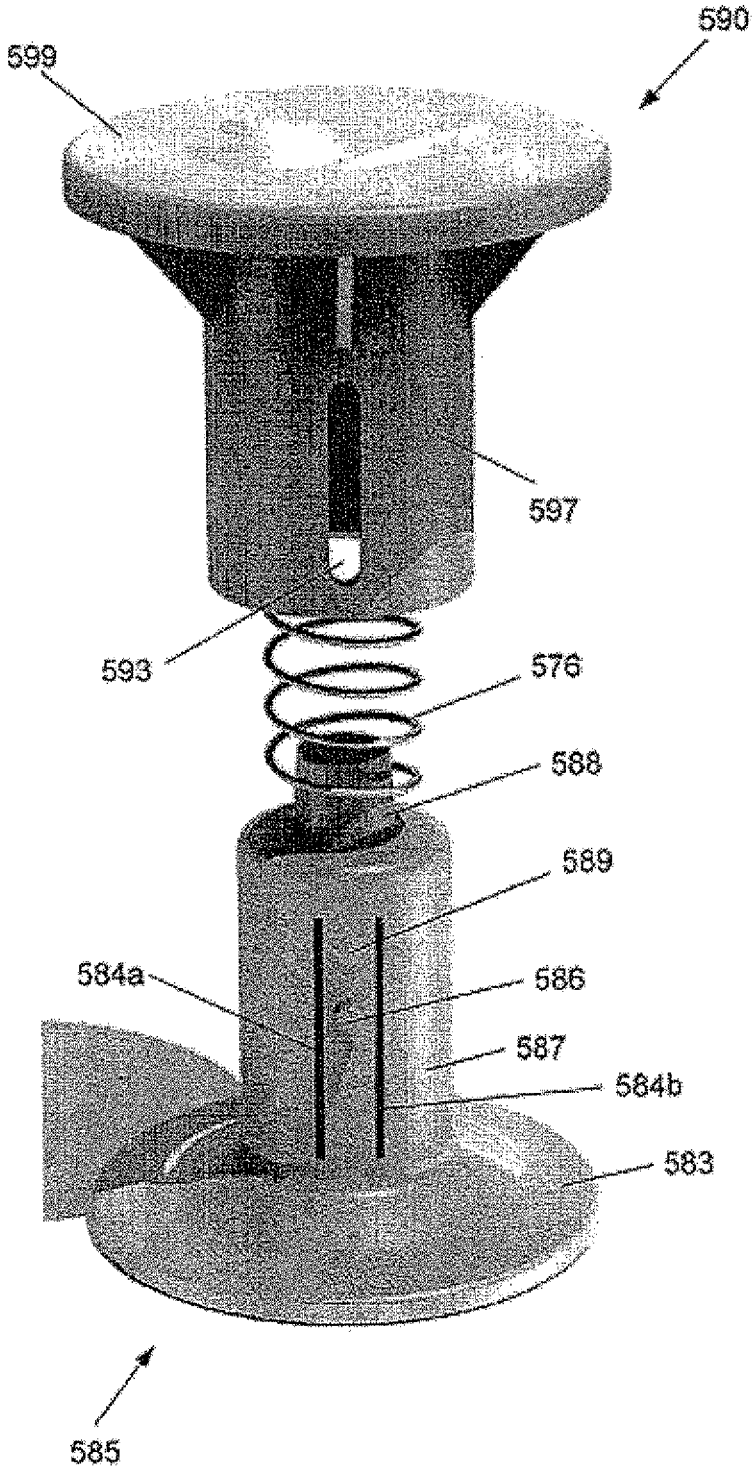
FIG. 25 illustrates a perspective view of the vibration transmitter of FIG. 23, shown in exploded fashion.

As also shown in FIGS. 24 and 25, vibration transmitter (590) comprises a lower member (585) positioned on movement sensor (584) and an upper member (595) that contacts air permeable layer (20) and is vertically displaceable with respect to member (585).

Vertically disposed body (587) of lower member (585), e.g. of tubular configuration, has an underlying base (583) which is placed on top of movement sensor (584). Post (588) on which is mounted coiled spring (576) upwardly protrudes from body (587). A pin (586) protrudes from each of two opposite sides of body (587), and is substantially perpendicular to post (588).

Upper member (595) has a hollow body (597) that surrounds body (587) of lower member (585) and an upper flange (599) substantially perpendicular to base (583) for contacting air permeable layer (20). Flange (599) is preferably made of, or covered by, a soft spongy material for protecting the person sleeping on layer (20). An elliptical groove (593) is formed in body (597) such that its major axis is vertically oriented. Pin (586) of member (585) is received in a corresponding groove (593) and urges member (595) to be displaced along a vertical path as groove (593) slides along pin (586). The bottom edge of groove (593) defines the uppermost position of upper member (590), as shown in FIG. 24.

Coiled spring (576) extends from post (588) to the underside of flange (599), and may be made of such a stiff material that it transmits vibratory motion of the sleeping person via layer (20), causing upper member (590) and lower member (585) to be displaced in unison, yet is sufficiently resilient to permit relative displacement between upper member (590) and lower member (585) when upper member (590) is directly contacted.

Vertical slits (584*a*) and (584*b*) may be formed in body (587), to provide a flexible portion (589) therebetween. Flexible portion (589) is pressed inwardly into the interior of body (587) when pin (586) is desired to be received in groove (593). Pin (586) may also be spring biased, so that it may be inwardly displaced before being inserted in the corresponding groove (593).

Figure 6:
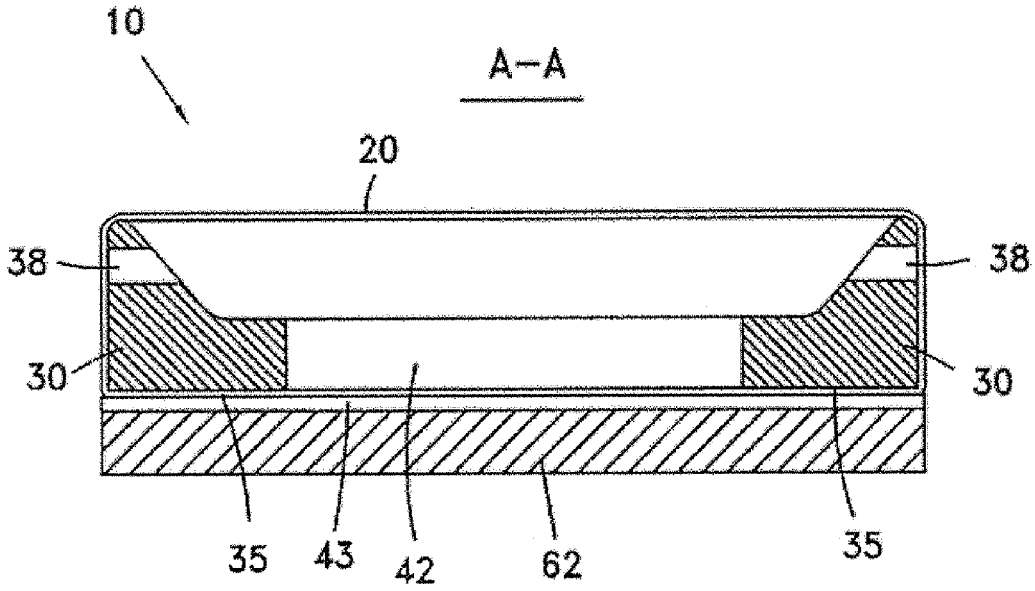
FIG. 6 illustrates a schematic cross-sectional view of an alternative embodiment of the present invention, taken along A-A of FIG. 1.

Additionally or alternatively, as shown in a schematic cross-section in FIG. 6, mutatis mutandis, a conventional mattress (62) is situated at the underside of frame (30) A rigid or semi-rigid thin layer (43), is disposed between mattress (62) and frame (30), for providing support for mattress (62).

Layer (43) may be removably fastened to bottom wall (35) by adhesive means such as Velcro™, tape, magnetic means, etc. When the infant is old enough to sleep on a conventional mattress without concern for the above-mentioned risks, support surface assembly (10) may be flipped over, and utilized as a conventional mattress. Although mattress (62) obstructs at least a portion of the air flow through layer (20), passageways (38) provide sufficient openings for the transfer of air between the infant and the surroundings. One advantage of providing support surface assembly comprising mattress (62) is to impart a psychologically appealing effect for a consumer who may otherwise be scared away from purchasing a sleeping surface with which he is unfamiliar.

Figure 7:
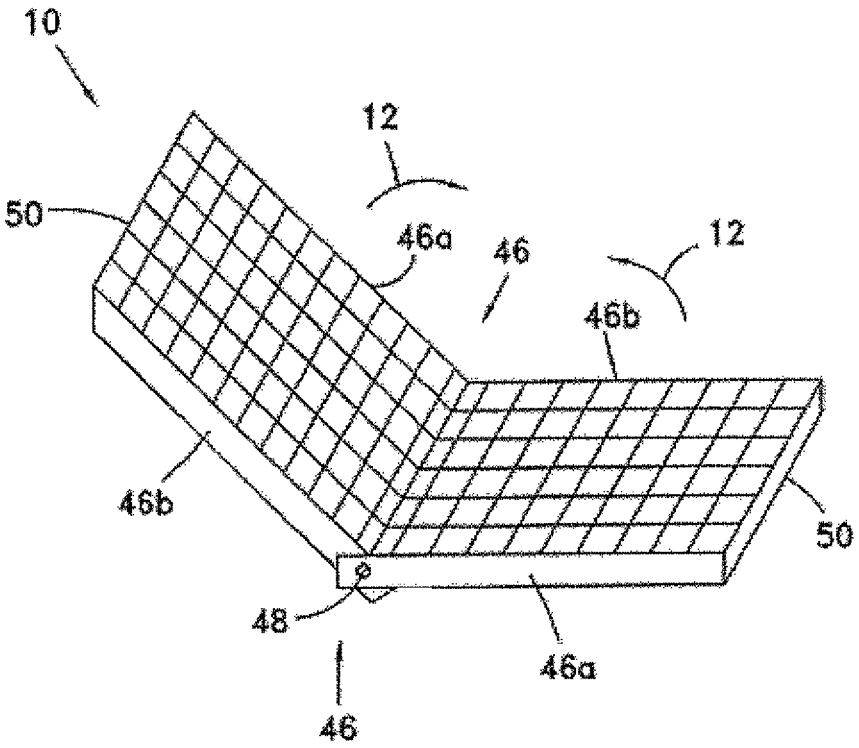
FIG. 7 illustrates a schematic perspective view of the present invention wherein the support surface assembly is inwardly foldable.

Optionally, support surface assembly (10) of the present invention is inwardly foldable, as indicated by arrows (12) in schematic FIG. 7. This allows support surface assembly (10) to be more easily transported as well as to be capable of being stored in a more compact location than when in a fully open position. Transverse sides (46) of frame (30) are comprised of first (46*a*) and second (46*b*) members, pivotably joined at their inner ends by pivot (48). A suitable latch mechanism (not shown) may be situated at the longitudinal ends (50) of frame (30) for maintaining support surface assembly in a folded position. When in an open position, the pivotably joined ends of first (46*a*) and second (46*b*) portions are locked in place by means well known in the art.

Figure 8:
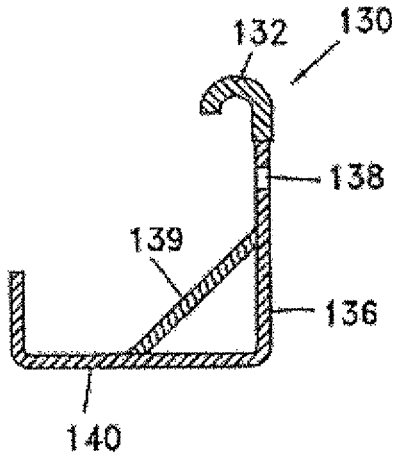
FIG. 8 illustrates a second embodiment of the frame of the present invention in a cross-sectional view.

In a second embodiment, the cross-section of frame (130) may be shaped according to the configuration shown in FIG. 8, mutatis mutandis, forming an L-shaped wire frame. This configuration allows even greater air flow at the area in proximity to frame (130) than that allowed in frame (30) of the first embodiment, since frame (130) comprises less volume than that of frame (30).

Passageway (138) is situated at the upper end of vertical portion (138) of frame (130). Supporting member (139) is optionally joined at one of its ends to vertical portion (138) and at the other of its ends to horizontal portion (140) of frame (130) for providing support thereto. Upper edge (132) is formed in a hook shape, and is preferably covered with padding as described herein above for frame (30) of the first embodiment, for instance, soft plastic or foam. It is understood that frames (30), (130) shown herein are merely illustrative embodiments, and any geometrical shape or configurations comprising the features as describes herein is included within support surface assembly (10) of the present invention.

Figure 9:
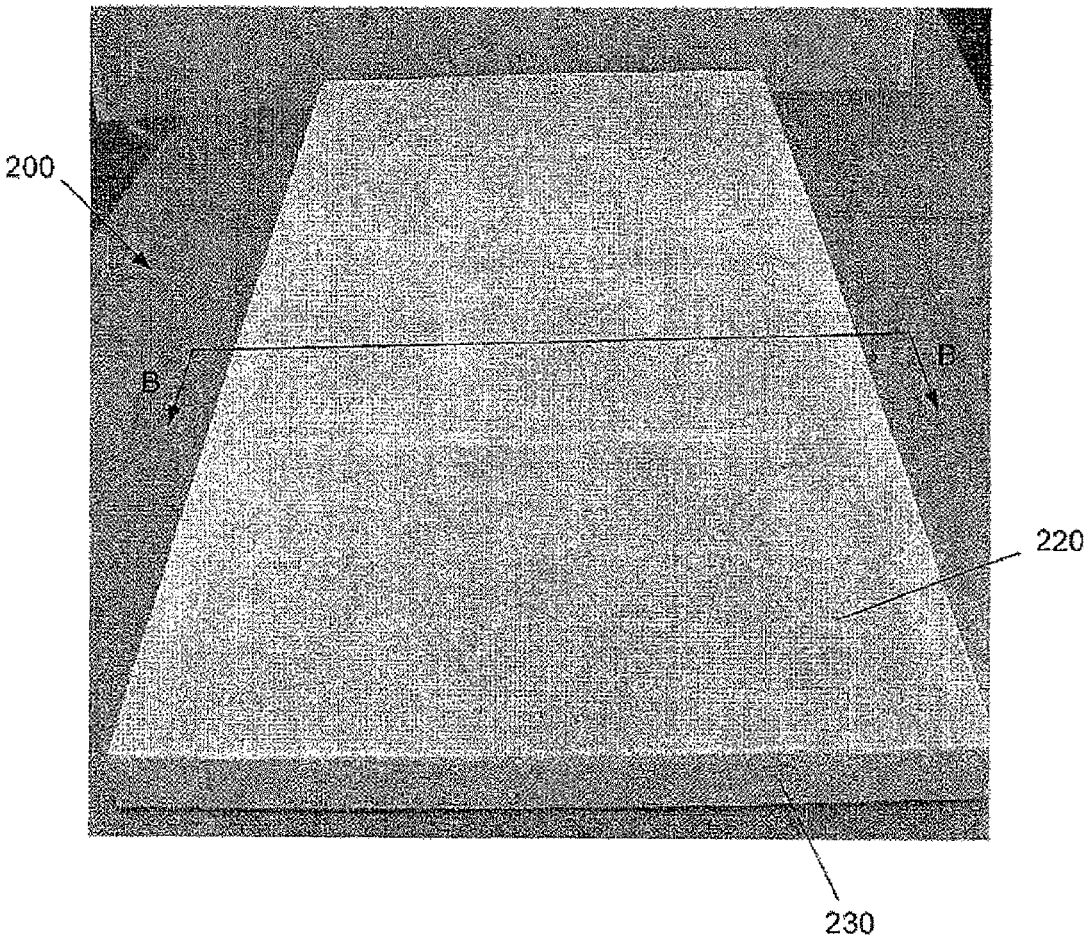
FIG. 9 illustrates a third embodiment of the present invention in a top perspective view.
Figure 10:
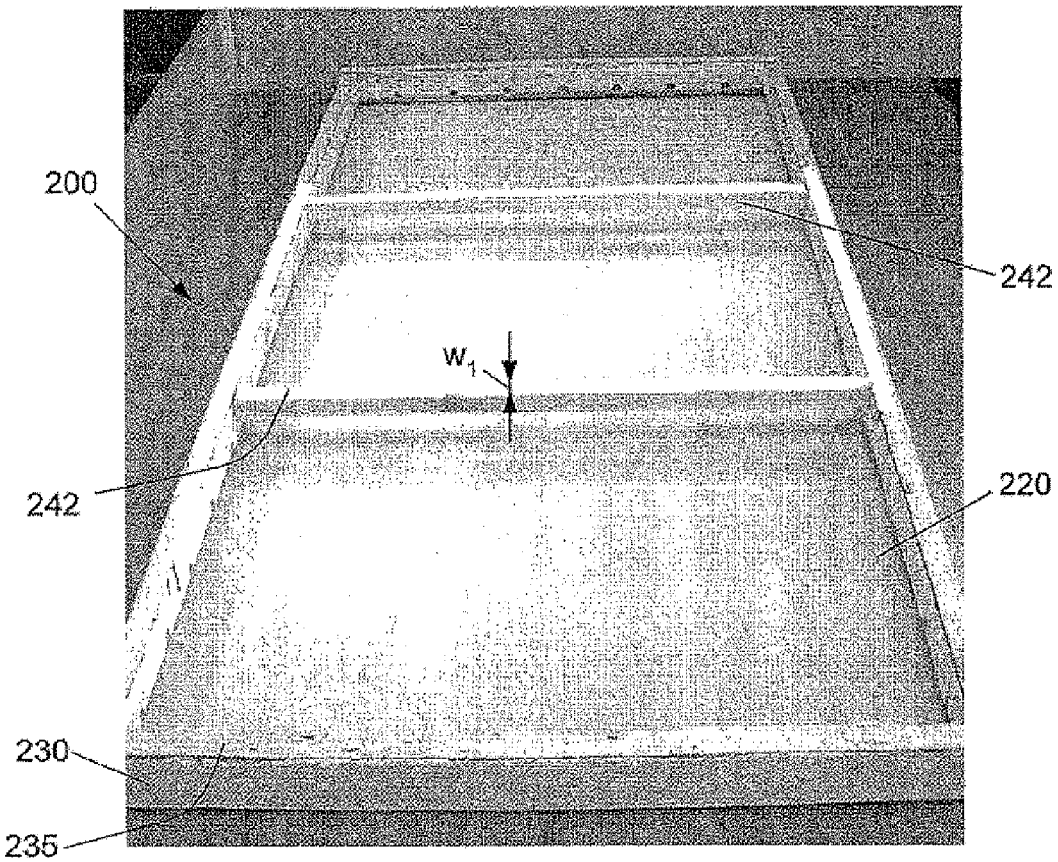
FIG. 10 illustrates the third embodiment of the present invention in a bottom perspective view.
Figure 11:
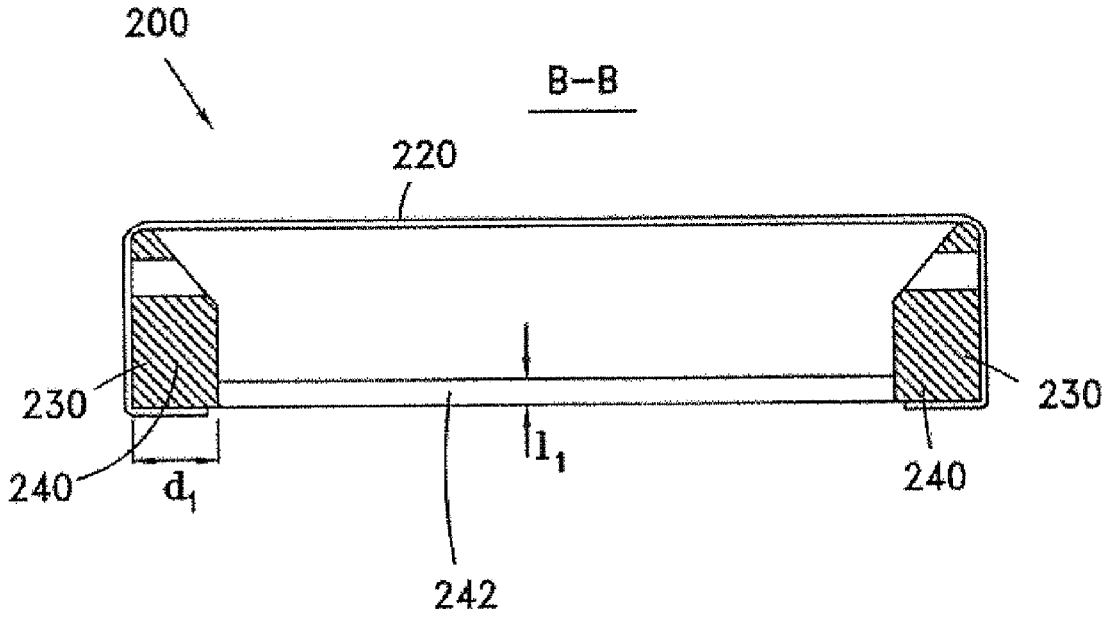
FIG. 11 illustrates a schematic cross-sectional view of the embodiment of the present invention shown in FIGS. 9 and 10 taken along B-B of FIG. 9.

A third embodiment of the support surface assembly of the present invention (200) is shown in FIGS. 9-11 comprising all of the same features as described herein above for the first embodiment, mutatis mutandis. A top perspective view of support surface assembly (200) is shown in FIG. 9, and a bottom perspective view of support surface assembly (200) is shown in FIG. 10. Air permeable layer (220) covers rigid frame (230), and is affixed thereto at bottom wall (235)

FIG. 11 shows a cross-sectional view of embodiment (200), taken across B-B of FIG. 9. When FIGS. 10 and 11 are contrasted to FIGS. 2 and 3 respectively, showing a similar view of support surface assembly of the first embodiment (10), it is appreciated that the elements of embodiment (200) are essentially the same, with the following differences. Thickness ($l_1$) as well as width ($w_1$) of cross-bars (242) are less than thickness ($l_2$) and width ($w_2$) of cross-bars (42). Additionally, cross-bars (242) are positioned at the lower portion (240) of frame (230), to allow a greater amount of air-flow underneath air-permeable layer (220). A further distinction between first embodiment (10) and embodiment (200), is shown in that the width ($d_1$) of lower portion (240) of frame (230) is less than the width ($d_2$) of lower portion (40) of frame (30). This, too, allows greater air-flow, especially when the infant's mouth is positioned in proximity to frame (230) (see FIG. 4).

Advantages of the third embodiment (200) include providing a support surface assembly having stability and strength similar to that of support surface assembly (10), yet comprising lower manufacturing costs due to less material required for the manufacturing process. Inexpensive manufacturing costs result in a lower cost to the consumer. Moreover, embodiment (200) is light weight due to the less amount of material used, which allows the user to easily transport the support surface assembly.

According to all embodiments of the present invention, even when the infant is sleeping in a supine position, it may be fully covered by a blanket or quilt, yet it may still breathe naturally without risk of suffocation.

According to another aspect of the present invention as described herein above, the support surface assembly can be used also for reducing the aggregation of dust and bacteria, particularly, the house dust mite that causes asthma, nasal allergy and some forms of eczema.

Figure 12A:
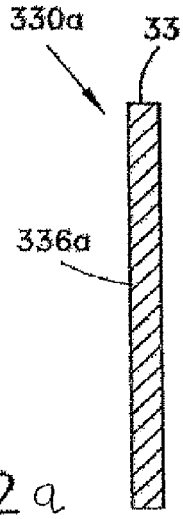
FIGS. 12*a*-12*d* illustrate alternative embodiments of the frame of the present invention in cross-sectional views.
Figure 12B:
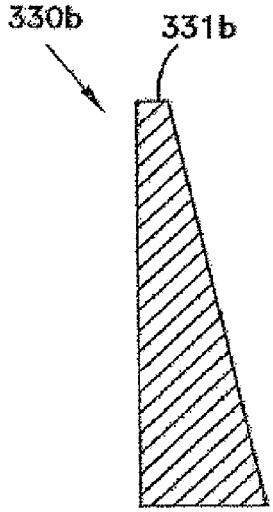
Figure 12C:
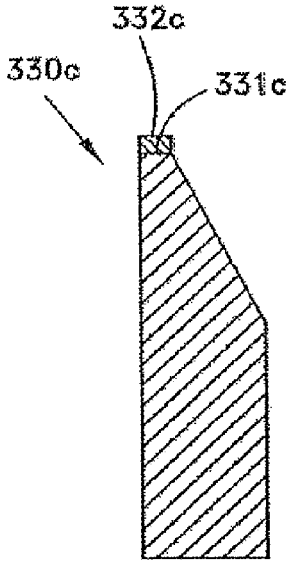
Figure 12D:
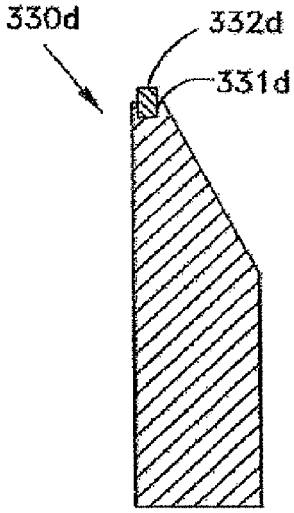

FIGS. 12*a*-12*d* show further alternative embodiments of the frame of the present invention, mutates mutandis, in cross-sectional views, showing only one side wall, for illustrative purposes only. Frame (330*a*) shown in FIG. 12*a* comprises an essentially vertical side wall (336*a*). The thickness and length of wall (336*a*) is determined, among other things, based on the strength of the material from which frame (330*a*) is made. Frame (330*b*) shown in FIG. 12*b* comprises a side wall having essentially a truncated right triangular shape. The dimensions of triangular frame (330*b*) may vary according to predetermined considerations. Upper edge (331*b*) is shown flat in this embodiment, however it is understood that upper edge (331*b*) may be rounded. FIGS. 12*c* and 12*d* show side walls of frames (330*c*), (330*d*) having a shape similar to that of embodiment (200) shown in FIG. 11. A padding, such as rubber, silicon, a spongy or foam material, soft plastic etc. preferably covers the upper edge (331*c*), (331*d*) of the frame as described above in relation to the first embodiment, and shown illustratively in FIGS. 12*c* and 12*d*. This feature is an additional safety feature of the frame of the sleeping surface for preventing injury due to contact with the upper edge. FIG. 12*c* shows padding (332*c*) in a horizontal position, essentially parallel to the permeable layer (not shown). FIG. 12*d* shows the upper edge of frame (330*d*) comprising a groove in which padding (332*d*) is situated. Other orientations and positions of the padding on the upper edge of the frame are understood to be within the scope of the invention. Although all of the embodiments of the frame shown in FIGS. 12*a*-12*d* are shown without a passageway (as shown in the other embodiments), it is understood that a passageway may be included. Moreover, it is understood that a passageway is not required to be present in any of the other embodiments.

As described herein above regarding the prior art, but related to the present invention as well, as the child grows in size, sagging of the air permeable layer occurs. This causes the child to sink and, in some cases, actually contact the crossbars. One or more of several solutions to this difficulty may be utilized, as described herein below.

Figure 13:
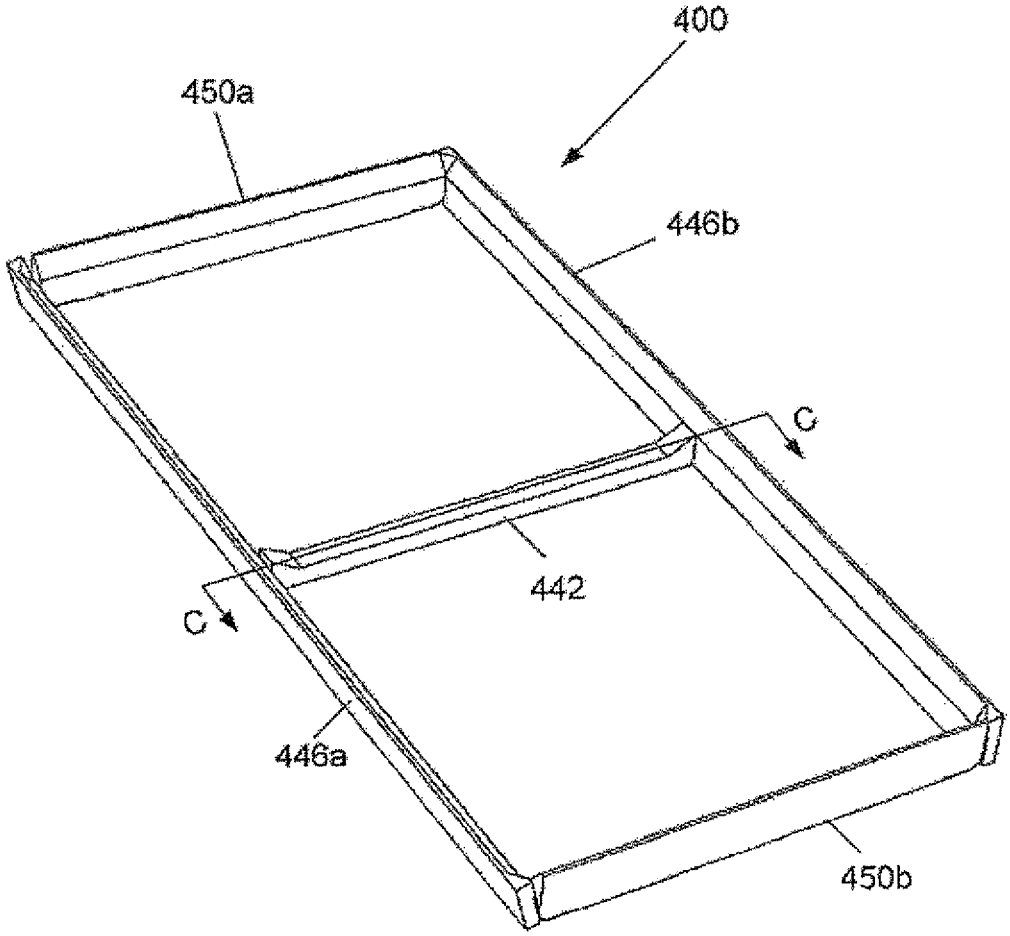
FIG. 13 illustrates a top perspective view of a first embodiment of the sagging correction mechanism.

FIG. 13 shows a top perspective view of an embodiment of a frame (400) of the present invention comprising a first embodiment of a mechanism for correcting the sagging resulting from extended use of a growing child (or an adult). According to this embodiment, transverse side walls (446*a*), (446*b*) are attached to cross bar (442) and to longitudinal walls (450*a*), (450*b*) by means of the mechanism to provide a constant stretching of the permeable layer (not shown) around transverse side walls (446*a*), (446*b*). Side wall (446*a*) is shown, for illustrative purposes, in an outwardly pivoted position. The cross-sectional profile of the side walls of frame (400) are essentially the same as that shown in FIG. 12*c*. Additionally, in frame (400), a single cross bar (442) is utilized, situated essentially at the midpoint of the transverse side walls (446*a*), (446*b*). Cross bar (442) comprises a unique cross-sectional profile (see FIG. 16), and situated at a distance from the air-permeable layer (not shown) such that even if some sagging occurs, the user will not contact the cross bar (442).

Figure 14:
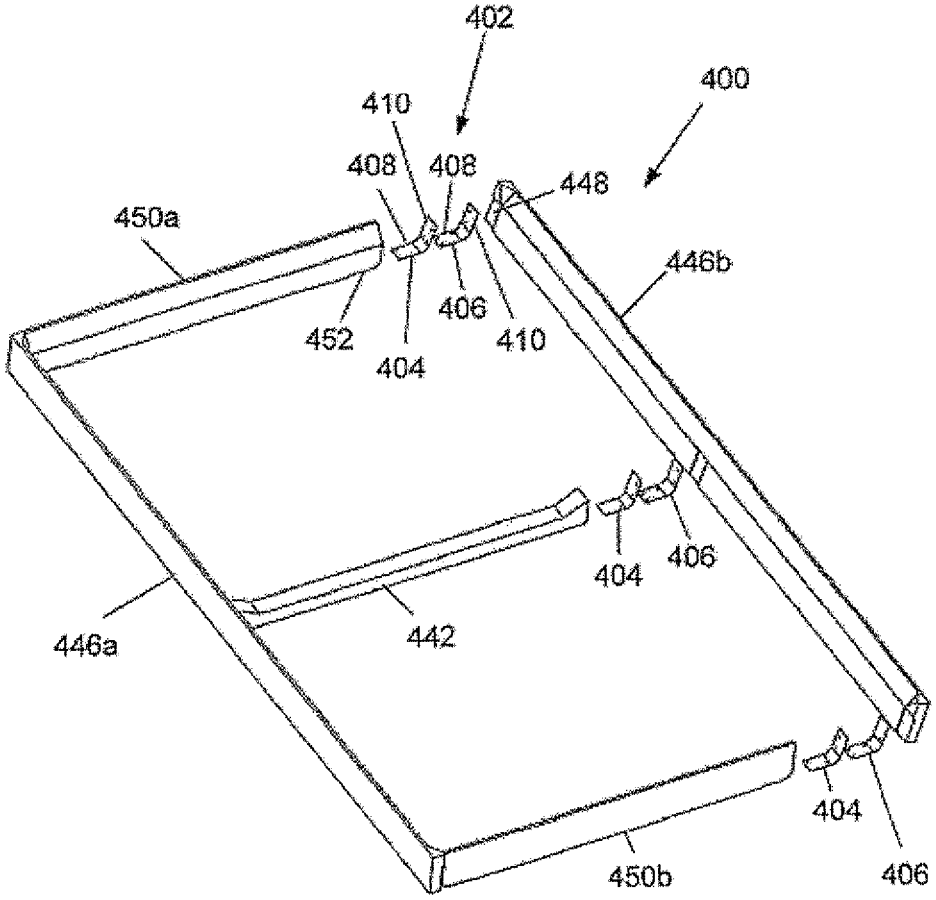
FIG. 14 illustrates a top perspective view of the embodiment shown in FIG. 13, with the correction mechanism in an exploded view.
Figure 15:
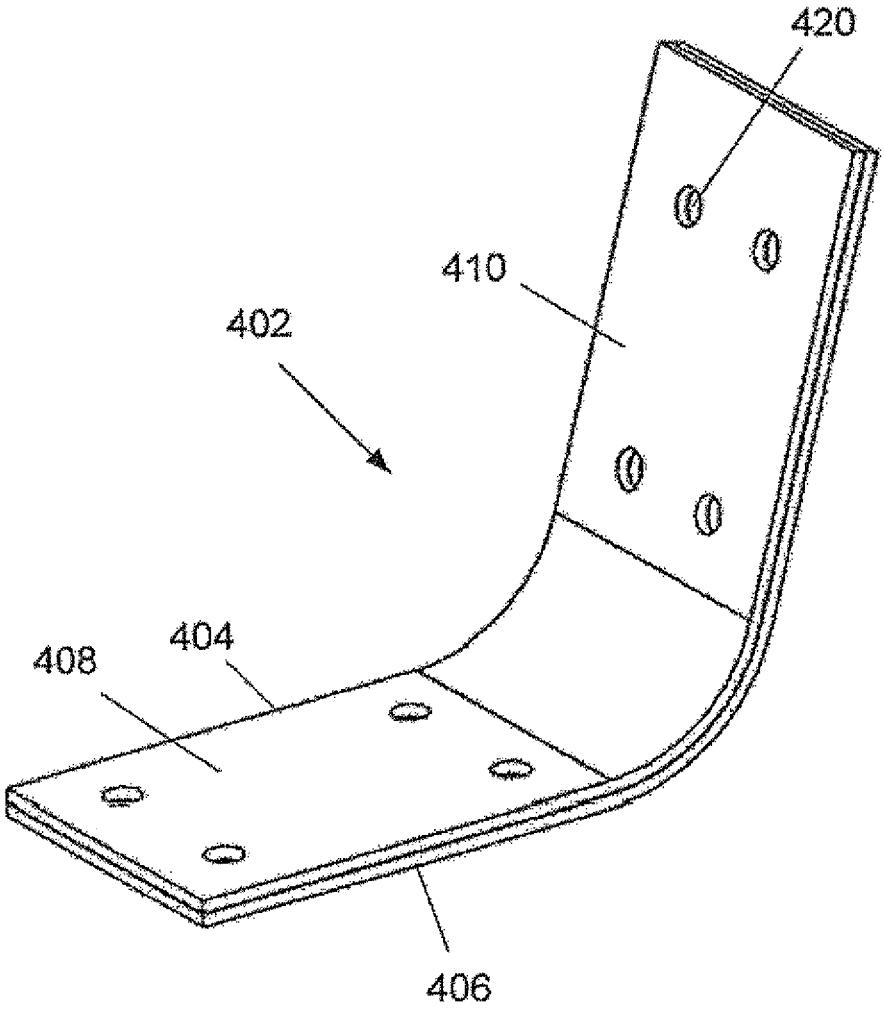
FIG. 15 illustrates the double plate spring for the correction mechanism of FIG. 13.

FIG. 14 shows an exploded view of the mechanism (402) for correcting sagging of the air-permeable layer (not shown). Mechanism (402) is shown for connecting transverse side wall (446*b*) to longitudinal walls (450*a*) and (450*b*), and to cross bar (442), however it is understood that a similar connection is present regarding transverse side wall (446*a*). Mechanism (402) comprises two steel, L-shaped spring loaded hinges (404), (406), disposed one on top of the other (see FIG. 15). The wings (408), (410) of hinges (404), (406) have an angle of preferably 95° between them, as described herein below.

Referring to the connection between longitudinal wall (450*a*) and transverse wall (446*b*), a first wing (408) of each hinge (404), (406) is joined to the underside of longitudinal wall (450*a*) at a recessed portion (452) cut out to receive wing (408). A second wing (410) of each hinge (404), (406) is joined to transverse wall (446*b*) at a recessed portion (448) cut out to receive wing (410). Hinge (404), (406) may be affixed to frame (400) by nails or screws passing through openings (420) (see FIG. 15), by glue, or by any other adhesive means.

Figure 16:
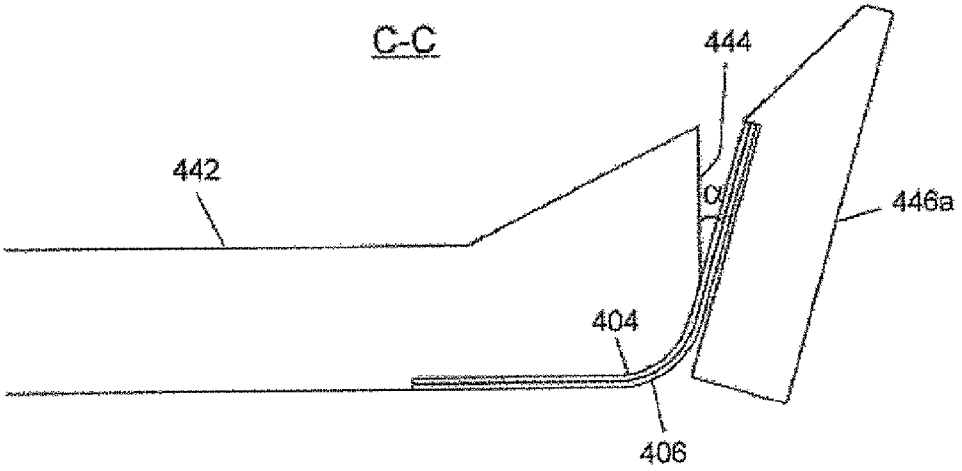
FIG. 16 illustrates a cross sectional view taken along C-C of FIG. 13, showing the side wall in an outwardly angled position with respect to the crossbar.

Thus, as seen in FIG. 16, showing a cross-sectional view taken along C-C of FIG. 13, when assembled, in the normal position, prior to the stretching of the air-permeable layer (not shown) over frame (400), transverse wall (446*b*) is at approximately a 5° angle ($\alpha$) with respect to the vertical end wall (444) of cross bar (442). When the air-permeable layer is stretched over the walls of frame (400), transverse wall (446*a*) is rotated to lie essentially flush with the vertical end (444) of cross bar (442), thereby reducing the angle ($\alpha$) to essentially zero. When a user lies down on the support surface assembly having mechanism (402), spring properties of hinges (404), (406) provide a constant outward force so that if sagging that occurs as a result of the weight of the user, hinge (404), (406) forces the transverse side walls, and thereby the air permeable layer, to stretch taut over the frame.

It is understood that although mechanism (402) is shown in the figures herein comprising two hinges (404), (406), only one, or more than two may be desired in some cases. Additionally, the thickness, material and angles of the hinges of mechanism (402), as well as the spring-like properties of the hinges, are shown and described herein for illustrative purposes, but may be altered by any man skilled in the art, for instance, according to the desired strength of the spring loading in view of the weight of the intended user of the support surface assembly.

Figure 17:
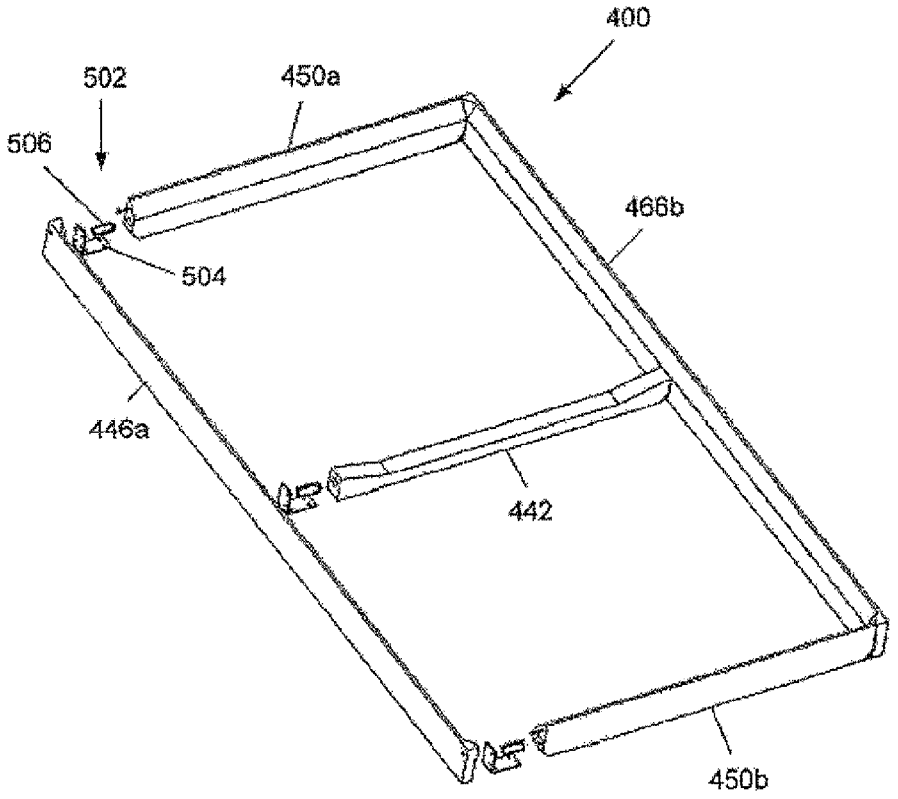
FIG. 17 illustrates a top perspective view of a second embodiment of a sagging correction mechanism, with the mechanism in an exploded view.

FIG. 17 shows a top perspective view of an embodiment of the frame (400) of the present invention comprising a second embodiment of a mechanism (502) for correcting the sagging, comprising all of the features and advantages of the first embodiment of the mechanism for correcting sagging, mutatis mutandis. According to the second embodiment, transverse side walls (446*a*), (446*b*) are pivotally attached to cross-bar (442) by means of spring loaded mechanism (502) comprising a hinge (504) and a compression spring (506).

Figures 18, 19:
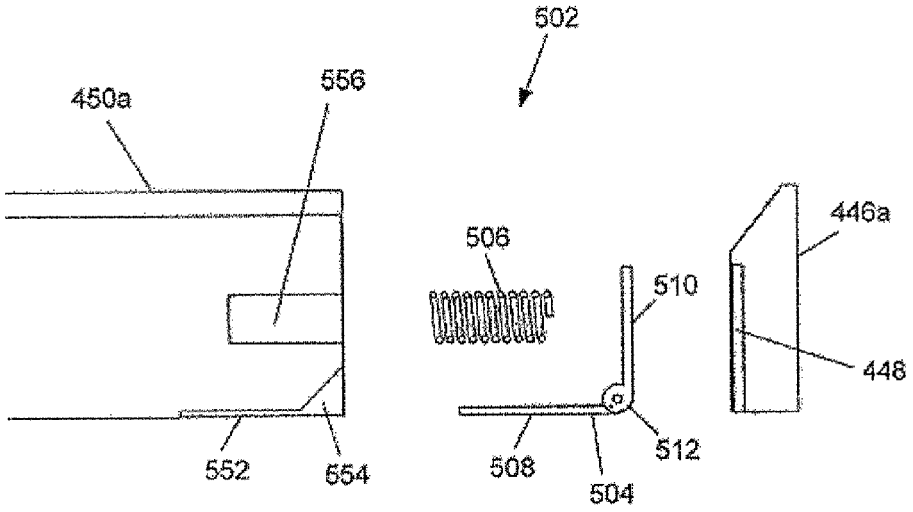
FIG. 18 illustrates a cross-sectional side view of the mechanism in an exploded view.
FIG. 19 illustrates the results of the first example, for determining the ability of the invention to prevent dust mites from accumulating on the support surface, in Table 1.

Referring to FIG. 18, showing a cross-sectional view of longitudinal wall (450*a*) and transverse wall (446*a*), with mechanism (502) in an exploded view, hinge (504) comprises a first (horizontal) wing (508) for joining to longitudinal wall (450*a*) at the cut out portion (552) situated at the underside of the wall (450*a*), and second (vertical) wing (510) for joining to transverse wall (446*a*) at the cutout portion (448). Horizontal wing (508) is joined to vertical wing (510) by a pivot joint (512). Longitudinal portion (450*a*) comprises an angled corner (554) for accommodating pivot (512) of hinge (504). Spring (506) is compressed and lodged within opening (556) in longitudinal portion (450*a*). When fully assembled, with the air permeable layer (not shown) stretched over frame (400), wings (508), (510) are oriented at a 90° angle as shown in FIG. 18. If a user lies on the air permeable layer, causing sagging, spring (506), forces first wing (510), and in turn transverse side wall (446*a*) outward, thereby pulling the air permeable layer taut over the frame.

It is understood that according to the second embodiment of mechanism (502), the number of springs (506) and the strength of springs (506) are determined by the man skilled in the art, depending on factors such as the expected maximum weight of the user of the support surface assembly.

Figure 21:
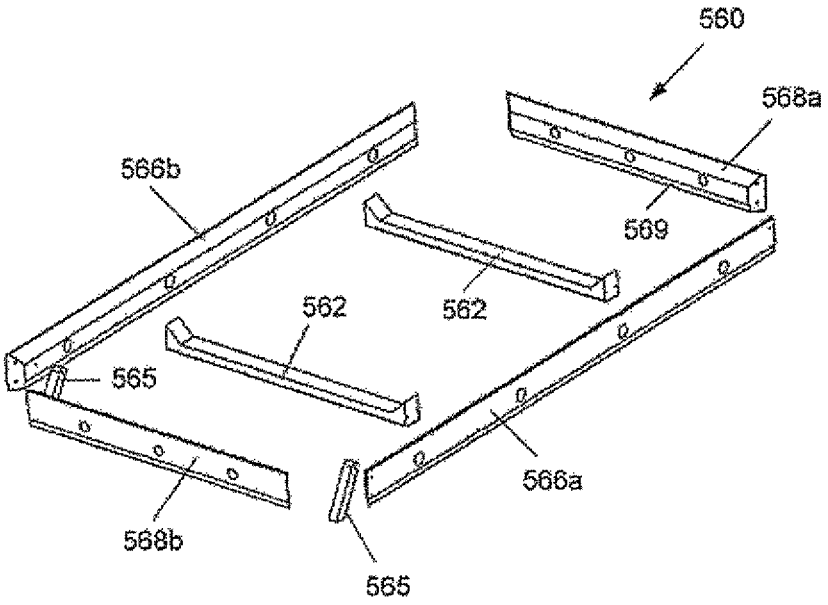
FIG. 21 illustrates a top perspective view of a frame in exploded fashion, according to another embodiment of the invention.
Figure 22:
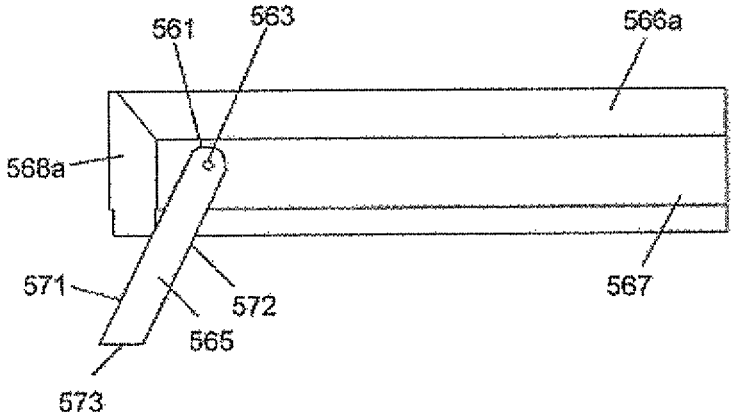
FIG. 22 illustrates a side view from the interior of an assembled transversal wall of the frame of FIG. 21, showing a downwardly extending pivotal leg.

In the embodiment illustrated in FIGS. 21 and 22, frame (560) is provided with a plurality of pivotal legs (565). A leg (565), which may have a rounded head (561), parallel edges (571) and (572) extending from head (561), and terminal edge (573) oblique to edges (571) and (572), is pivotally connected by means of a corresponding axle (561) to inner side wall (567) of transversal walls (566*a*) and (566*b*), preferably at each longitudinal end thereof. The length of each leg (565) is generally less than the spacing between axle (561) and an adjacent cross bar (562), so that a leg may be normally stowed along an inner side wall (567). By rotating two opposite legs (565) so that they downwardly extend from transversal walls (566*a*) and (566*b*) and their terminal edge (573) contacts a frame support of the bed, one longitudinal end of frame (560) will be elevated. The rotation of a leg (565) is limited by means of bottom edge 569 of an adjacent longitudinal wall (568*a*) or (568*b*), as shown in FIG. 22.

A pillow may therefore be rendered unnecessary and bodily fluids discharged from the sleeping person may therefore be quickly discharged from the air-permeable layer via the sloping surface. The removal of discharged bodily fluid is also facilitated by means of the sloping surface of the triangular upper portion of frames (330*b*)-(330*d*) illustrated in FIGS. 12*b-d*, respectively.

When the present invention is used by an adult, or a non-infant child, the risk of injury due to contact with the frame is less than that for an infant. Therefore, the upper edge of the frame may comprise a thickness greater than that required for when utilized by an infant. For instance, the upper edge may be as thick as 100 mm. Nevertheless, due to the allergenic factors as well as the presence of dust mites as described herein above, it is still preferable for the upper edge to be thin like when used for an infant.

Additional advantages of the present invention include providing relief from pressure build-up and bed-sores of a person who is confined to a bed for an extended period of time. Lack of movement of body parts prevents oxygen from reaching and circulating properly throughout the body. The support surface assembly of the present invention may alleviate such problems.

The support surface assembly of the present invention may be disassembled and washed periodically as described herein above. This is especially beneficial for those suffering from incontinence, particularly children and the elderly, as well as those who perspire in large amounts during sleep. In addition, since the support surface assembly is preferably elastic, it avoids the formation of sleeping patterns. Using the support surface assembly proposed by the present invention, the sleeping infant constantly sleeps on a "memory-less" surface, which is equivalent to a new mattress, on which the infant sleeps repeatedly.

The support surface assembly may be utilized in unconventional situations such as by a soldier situated in a bunker or in a tent on the battle field, where sleeping arrangements that are easily assembled, disassembled and cleanable are desirable.

FIGS. 26-41 illustrate another embodiment for tensioning the air-permeable layer. In this embodiment, a peripheral portion of the air-permeable layer is received in a groove formed in a corresponding frame section and is secured within the groove by means of a pressure fit. The air-permeable layer is further tensioned by means of the concurrent pivoting of two or more adjacent frame sections, as will be described hereinafter.

Figure 26:
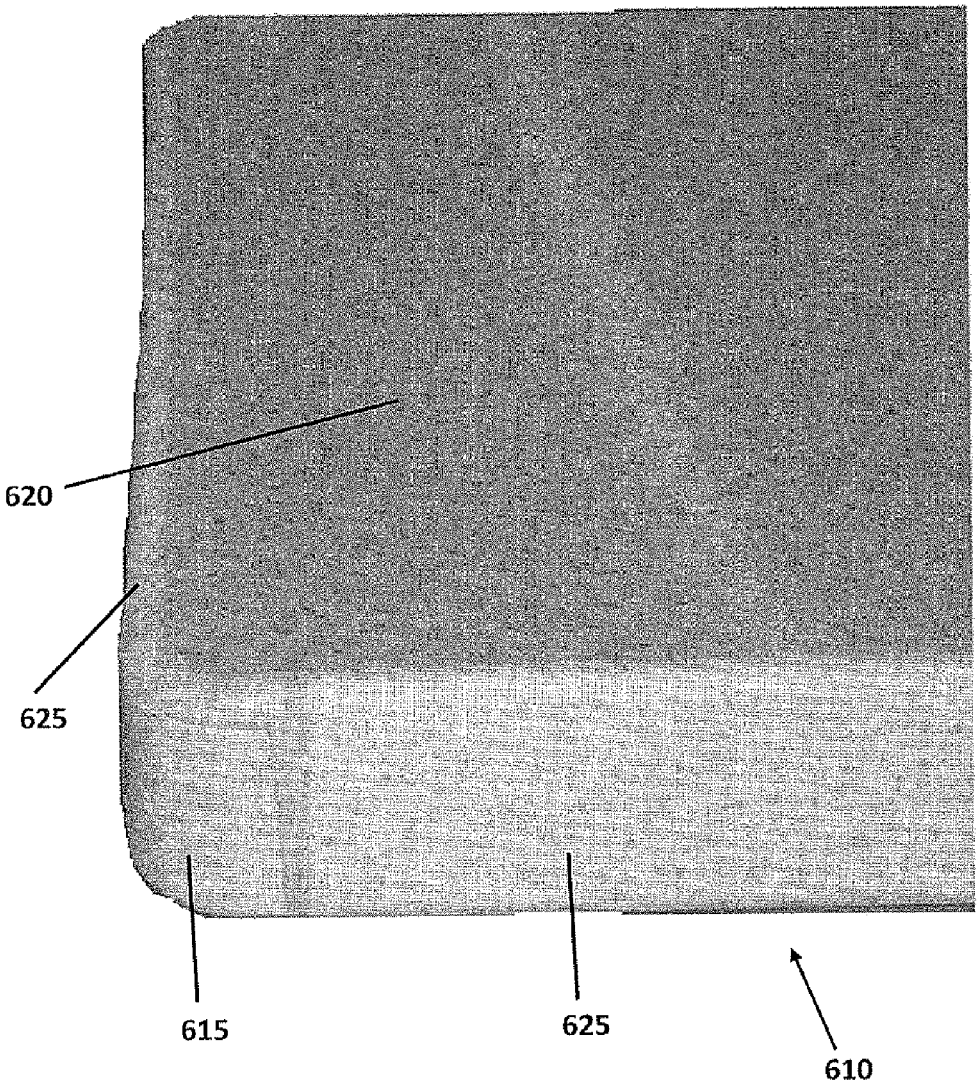
FIG. 26 illustrates a top perspective view of another embodiment of a support surface assembly.

As shown in FIG. 26, support surface assembly (610) comprises four rounded corner elements (615) and four frame sections (625) defining a rectangular perimeter. Two adjacent frame sections (625) are pivotally connected to a common corner element (615). After air-permeable layer (620) is secured to the frame sections (625), the latter are pivoted so as to be substantially flush with a wall of the corner element (615) while the tension of air-permeable layer (620) is considerably increased.

Since frame sections (625) are concurrently pivoted, the entire sleeping surface of air-permeable layer (620), i.e. suspended between opposite frame sections, is tensioned to a substantially uniformly high level. For a mattress having dimensions in the range of 0.8-1.0 m width and 1.4-1.6 m length, the sleeping surface is tensioned to a level ranging from 700 kg to 800 kg and greater than 650 kg in the longer dimension of the mattress and from 400 kg to 500 kg and greater than 350 kg in the shorter dimension of the mattress. Those tensions withstand sagging for a period of at least three years during normal infant usage.

One suitable air-permeable layer (620) is a screen printing mesh made of polyester. Such a layer has a tensile strength of greater than 1000 N that can withstand a concentrated load of greater than 400 N without being punctured and is fatigue resistant during 2000 pressure applications of 10 N/100 $cm^2$. An exemplary air-permeable layer is the PET 1000 15/40-200 W PW screenprinting mesh manufactured by Sefar AG, Thal, Switzerland made of polyester and having a warp and weft mesh count of greater than 14.5/cm and a fabric thickness of less than 375 microns.

The tensioning of the air-permeable layer is caused by the increase of the initial distance between groove centers to a final elongated distance when the frame sections (625) are flushed with the corners (615). The elongation is kept well within the material elastic range. For example, for a PET net elongation of the initial distance is preferably kept in the range of 1-4%.

Figure 27:
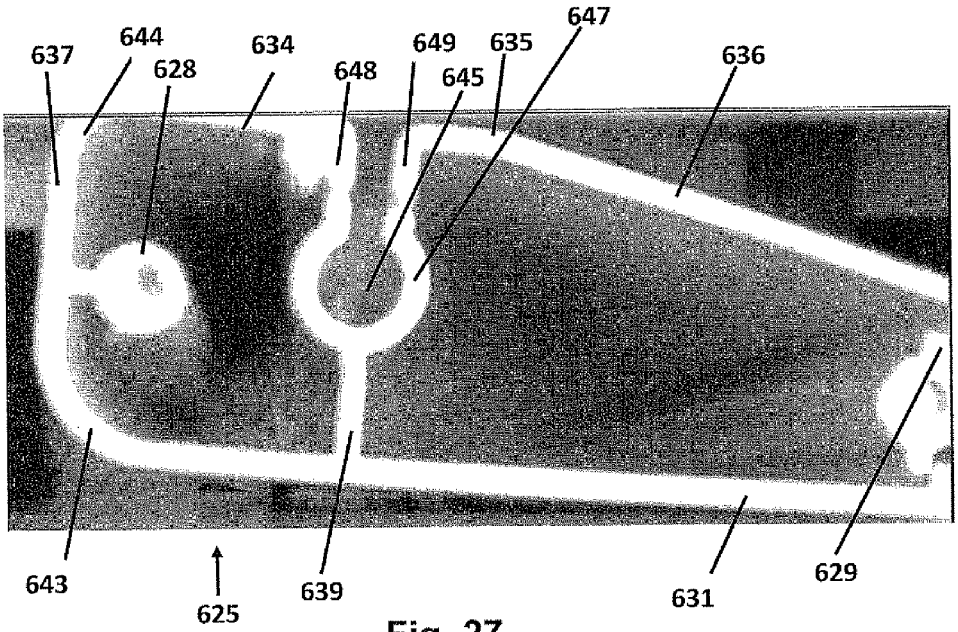
FIG. 27 illustrates a side view of a frame section used in conjunction with the support surface assembly of FIG. 26.
Figure 33:
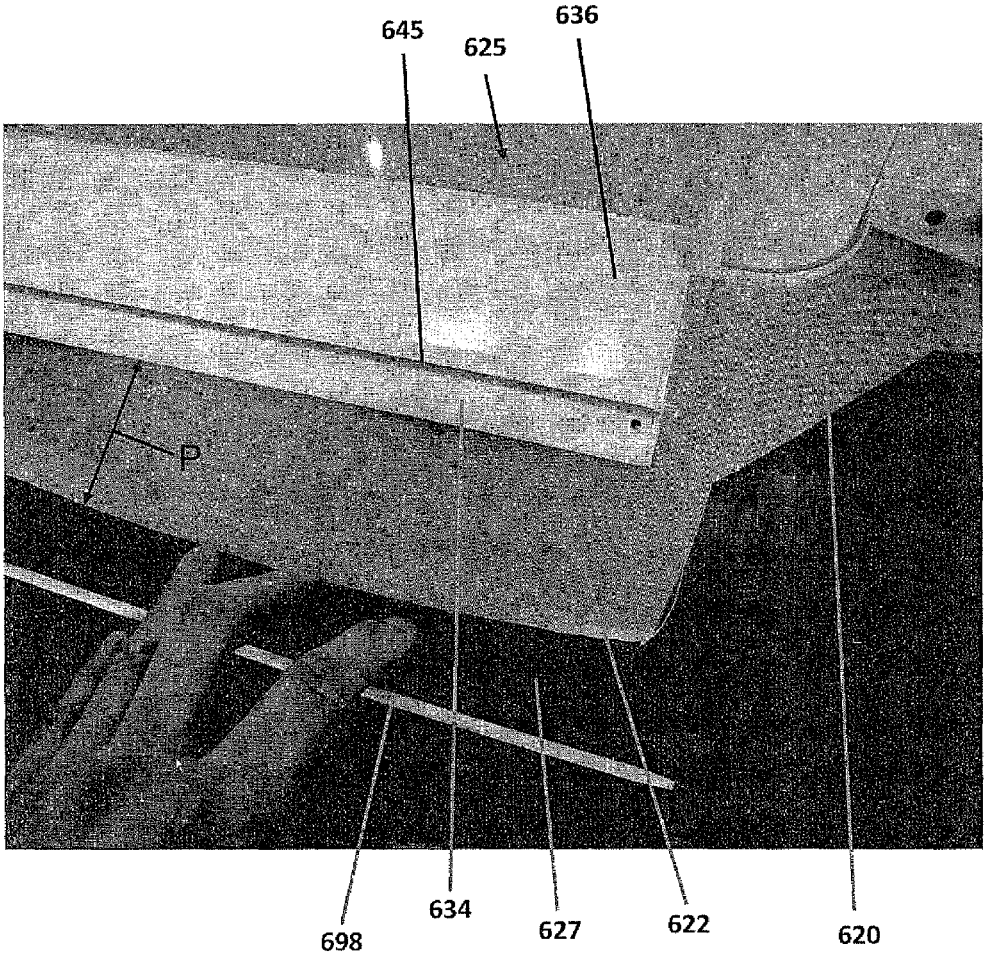
FIG. 33 illustrates a top view of a frame contactable portion of the air-permeable layer before being tensioned.
Figure 35:
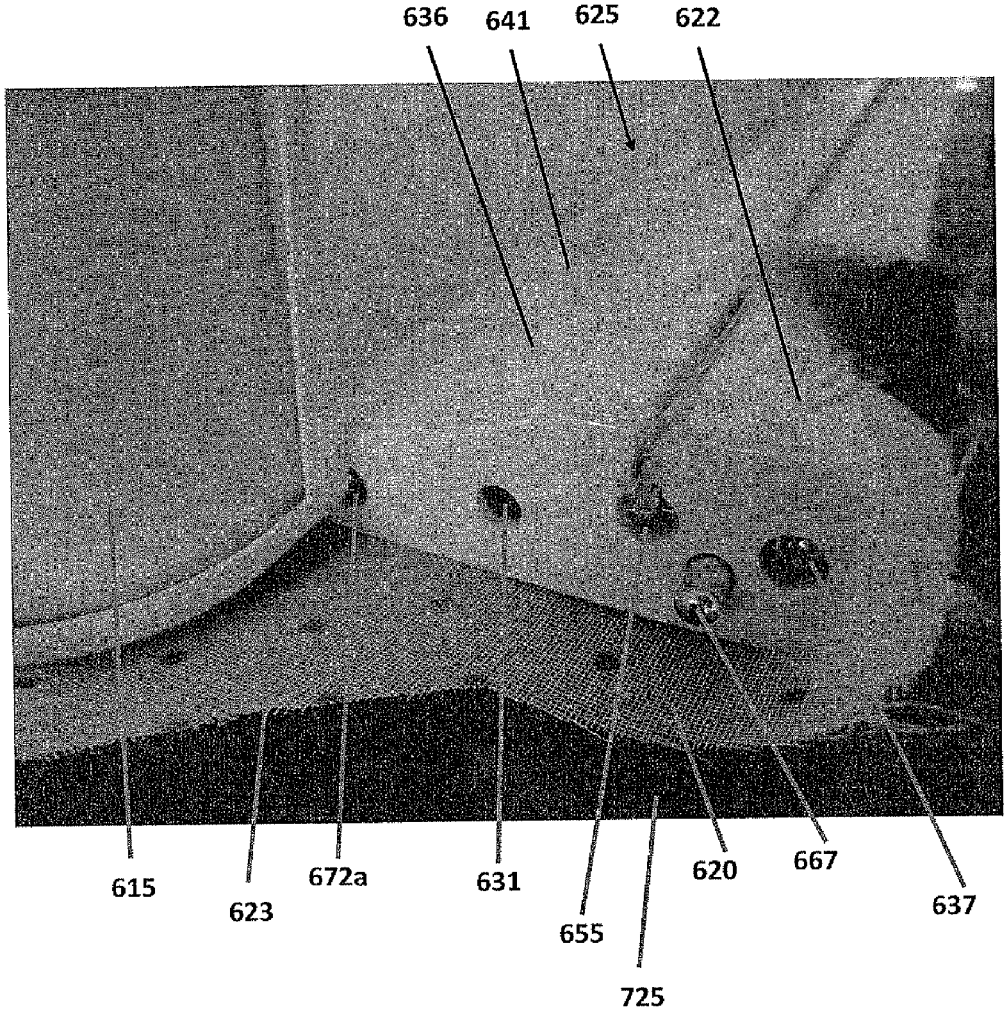
FIG. 35 illustrates a bottom perspective view from the side of a frame section of FIG. 27 in the pre-tensioning position after the air-permeable layer has been secured thereto.

As shown in FIGS. 27, 33 and 35, each frame section (625), which may be made of aluminum or of any other metallic or plastic rigid material, has a planar outer wall (631), a bottom wall (637) substantially perpendicular to outer wall (631), a lower inner wall (634) substantially parallel to wall (631), an upper inner wall (636) oblique with respect to wall (631), and two fixedly attached screw receiving elements (628) and (629). Upper inner wall (636) extends away from bottom wall (637) and terminates with upper edge (641) substantially parallel to bottom wall (637). The width of upper edge (641) ranges from 8 to 15 mm while the width of bottom wall (637) ranges from 30 to 50 mm, in order to reduce risk of injury if the sleeping person falls on the air-permeable layer in the vicinity of frame section (625). Bottom wall (637) is provided with rounded portions (643) and (644) extending to outer wall (631) and lower inner wall (634), respectively, to ensure that air-permeable layer (620) will not tear when being secured to frame section (625) and subsequently tensioned.

Longitudinal groove (645), in which the peripheral portion of air-permeable layer (620) is secured, is defined by an arcuate wall (647) subtending an angle of approximately 330 degrees, and by mutually parallel guide elements (648) and (649) extending from arcuate wall (647) to lower inner wall (634) and intermediate wall (635), respectively, for the insertion therebetween of the peripheral portion. Longitudinal groove (645) has an axis which is substantially parallel to outer wall (631). Intermediate wall (635) is adjacent to inner wall (636) and substantially parallel to outer wall (631). A reinforcing rib (639) extends from arcuate wall (647) to outer wall (631).

Figure 28:
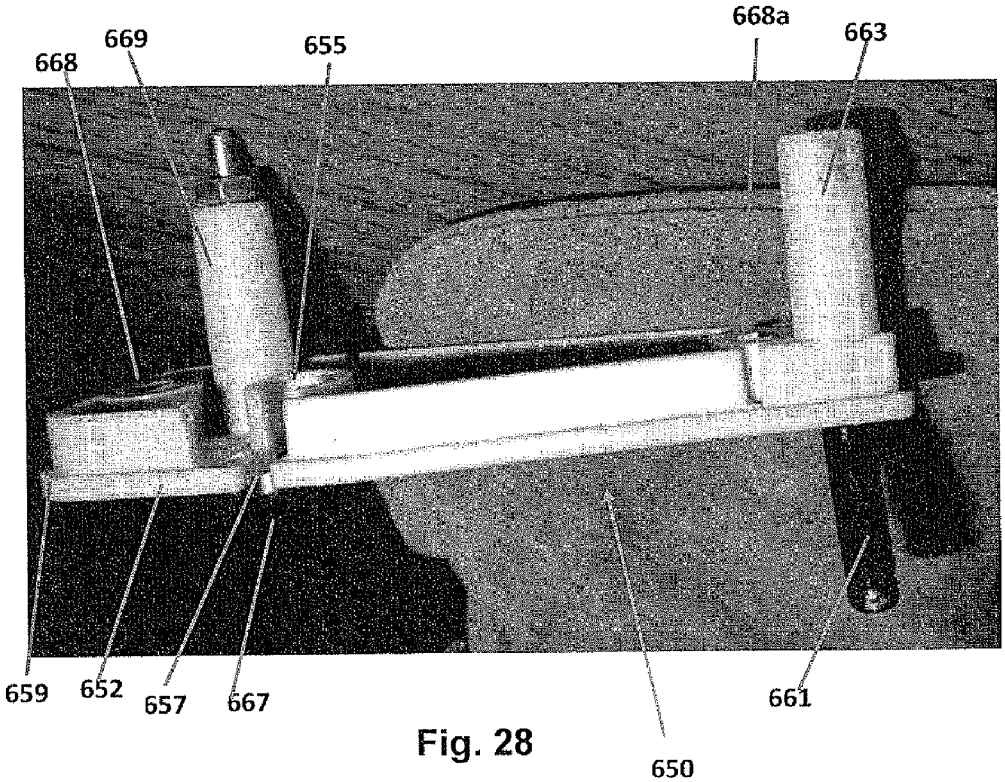
FIG. 28 illustrates a side view of a cover member connectable to the frame section of FIG. 27.
Figure 29:
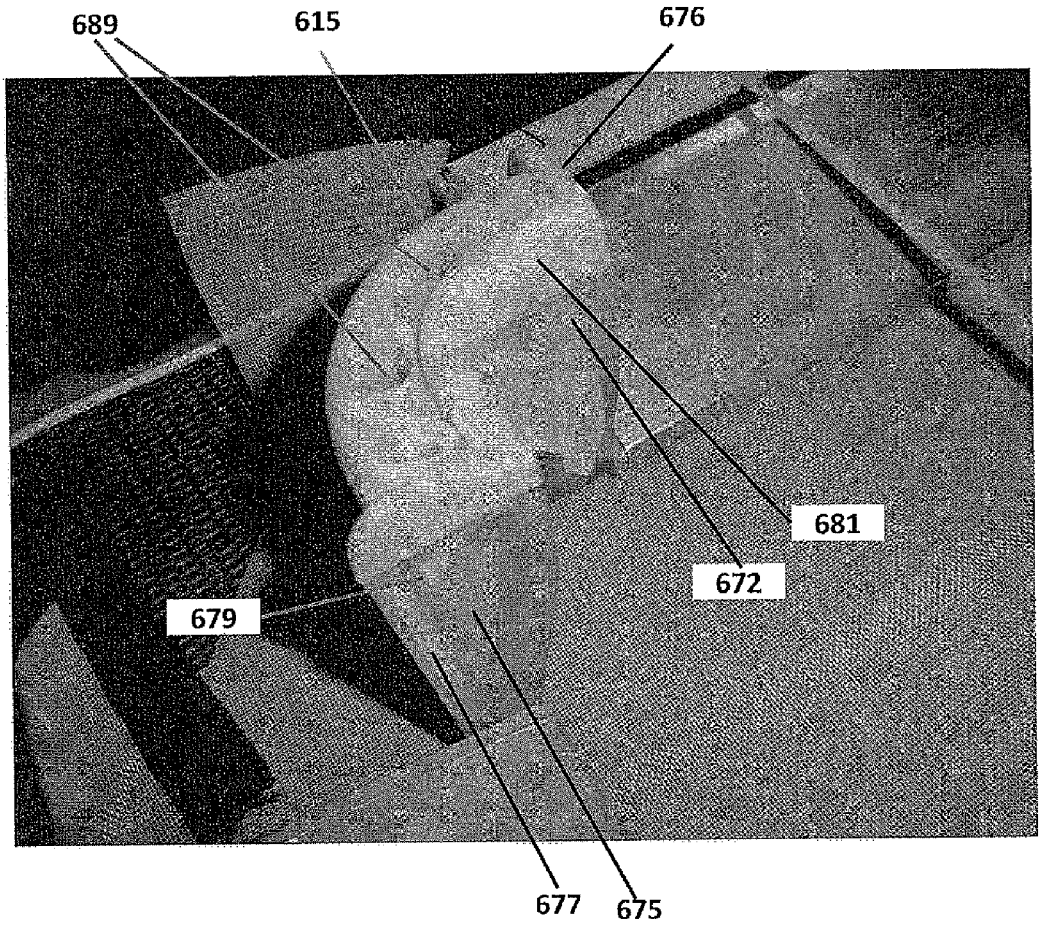
FIG. 29 illustrates a bottom perspective view from the side of a corner element used in conjunction with the support surface assembly of FIG. 26.

Cover member (650) connectable to frame section (625) is illustrated in FIGS. 28 and 29. Cover member (650) has a plate (652) that faces an adjacent corner element and is shaped with a similar profile as frame section (625). Walls of aperture (655) and slot (657) formed in cover member (650) are shaped similarly as groove (645) shown in FIG. 27. To allow the pivoting of frame section (625) relative to a corner element, cover member (650) is provided with an axle (661) mounted within mount (663) laterally protruding from plate (652) in the proximity of upper edge and with a pin (667) of FIG. 30 biased by means of spring assembly (669) laterally protruding from plate (652) between slot (657) and bottom edge (659). Apertures (668) and (668*a*) formed in plate (652) are aligned with screw receiving elements (628) and (629), respectively, so that cover member (650) can be connected to frame section (625).

Figure 30:
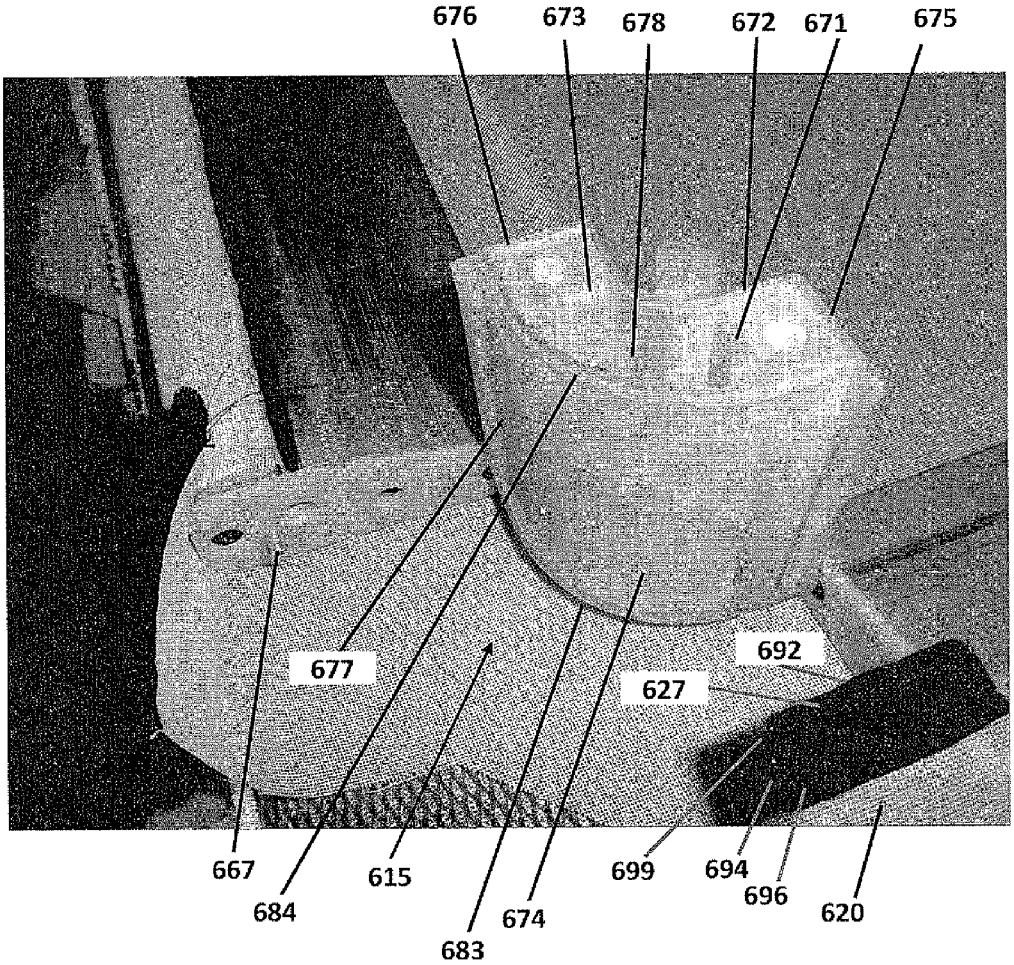
FIG. 30 illustrates a bottom perspective view of the corner element of FIG. 29 when its bottom cover is removed and two frame sections coupled thereto are in the pre-tensioning position.
Figure 31:
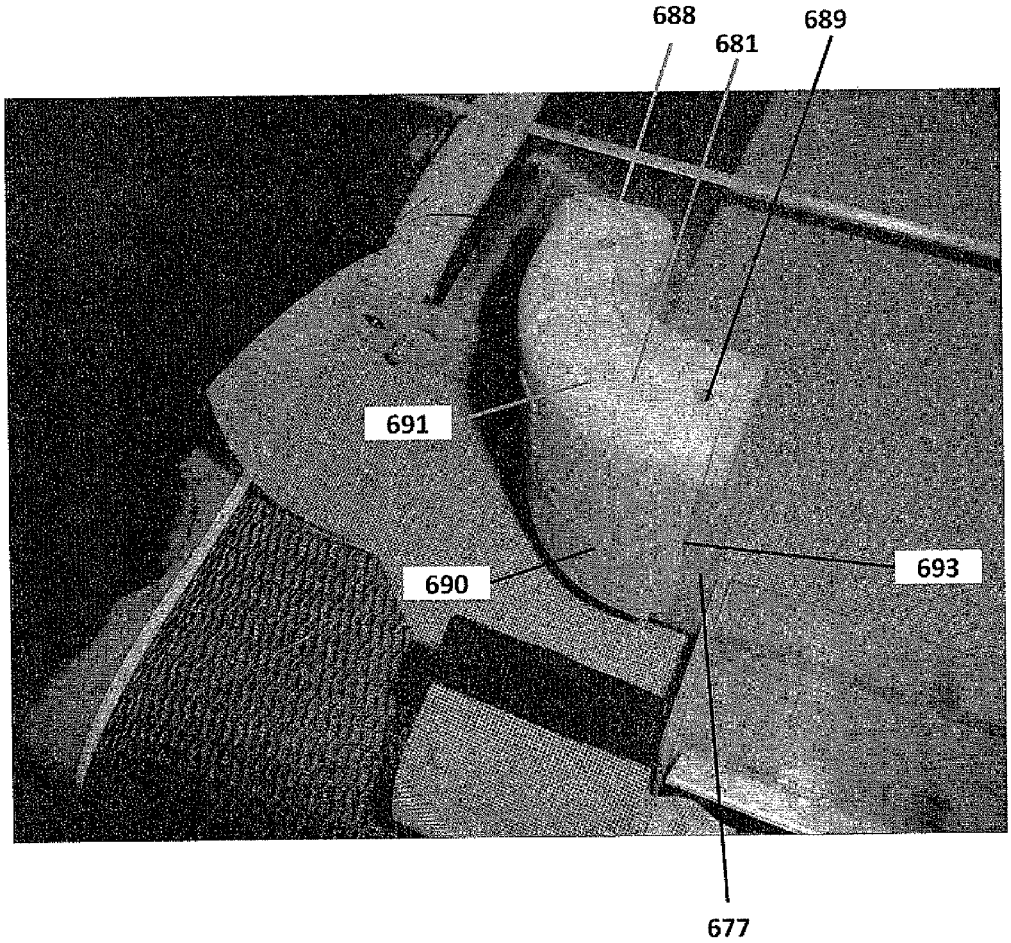
FIG. 31 illustrates a bottom perspective view of the corner element of FIG. 29, showing a decorative shield attached thereto.

FIGS. 29-31 illustrate corner element (615). Corner element (615) has an arcuate inner wall (672) and an outer wall (674) surrounding inner wall (672), both of which subtending an angle of approximately 90 degrees and terminating at the two straight ends thereof with interface elements (675) and (676), respectively. By providing corner element (615) with such a rounded configuration, the frame sections of the support surface assembly can be placed in abutting relation with the end and side units of the bed which supports the support surface assembly, without having to leave a clearance in the vicinity of a corner, as has been necessary heretofore with respect to prior art support surface assemblies having a rigid frame due to the configuration of the bed. Since the support surface assembly frame sections of the present invention are placed in abutting relation with the end and side units of the bed, a risk of being injured by a frame section if the sleeping person falls on the air-permeable layer is negligible or nonexistent. It will be appreciated, however, that the support surface assembly of the present invention will also provide a uniformly tensioned air-permeable layer of a high level when a rectilinear corner element is employed.

Each interface element (675,676) extends radially outwardly from inner wall (672) and has a protruding portion (677) which protrudes from outer wall (674). An upper aperture (672*a*) shown in FIG. 35 and a lower aperture (679) are bored in each interface element, and are adapted to receive axle (661) and pin (667), respectively. Interface elements (675) and (676) are configured with planar, rectangular abutment plates (671) and (673), respectively, each of which being substantially coplanar with bottom edge (684) of corner element (615) and extending between inner wall (672) and outer wall (674). Corner element (615) has a hollow interior (678) defined by the interspace between inner wall (672) and outer wall (674) and between abutment plates (671) and (673), and an upper surface (683) provided with two apertures (not shown).

Corner element (615) may also have a bottom cover (681) attachable to abutment plates (671) and (673), or otherwise integrally formed with the corner element. Cover (681) has a recessed surface in which are formed large-holed apertures (688) and (689), by which an immobilizing device can be coupled, as will be described hereinafter. A decorative shield (690) contacting outer wall (674) may be attached to corner element (615) such that bottom surface (691) of the shield will be substantially coplanar with bottom cover (681) and each circumferential edge (693) of the shield will contact protruding portion (677) of the corner element.

An exemplary cover element may be made of nylon reinforced with glass fibers, e.g. PA6 and GF 40%, with its inner and outer walls having a thickness of 3-4 mm. The decorative shield may be made of ABA (Acrylonitrile Butadiene Styrene).

Figure 32:
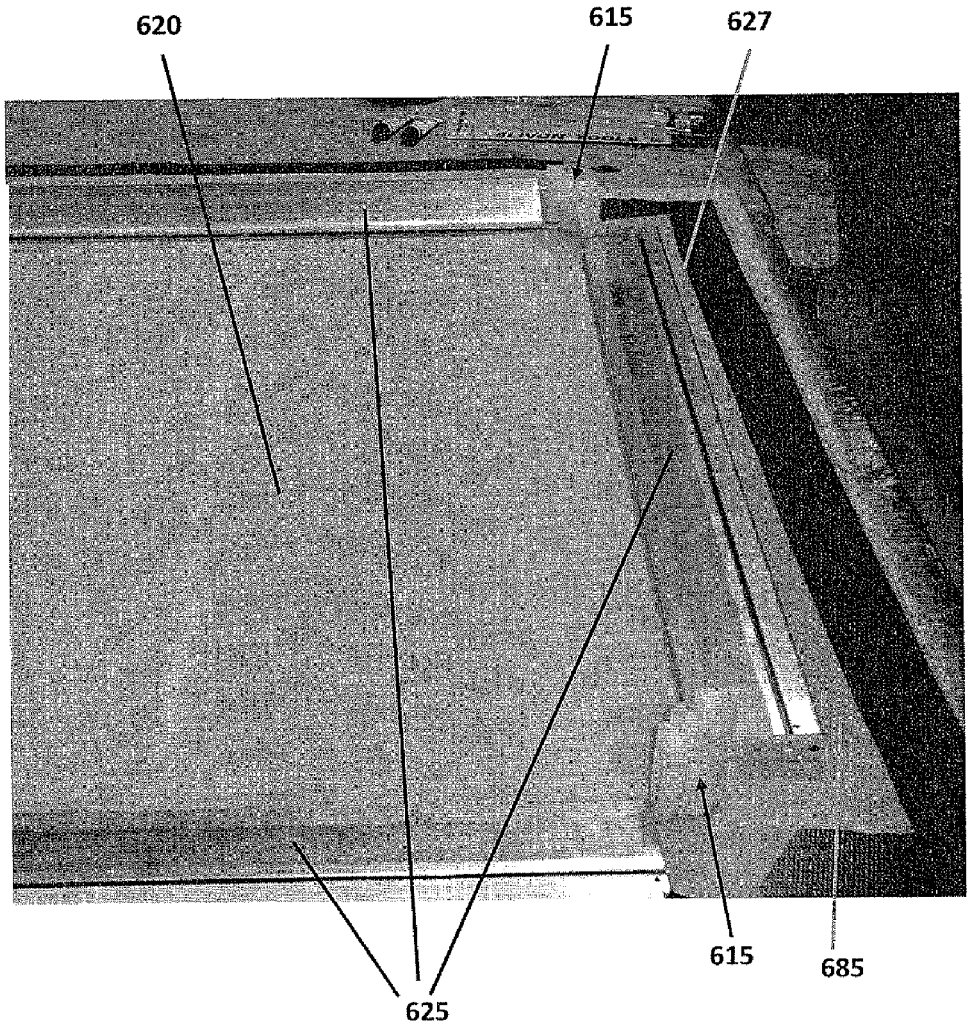
FIG. 32 illustrates a top view of the air-permeable layer before being tensioned, showing a plurality of frame sections and corner elements placed thereon.

FIG. 32 illustrates air-permeable layer (620) before being tensioned. The upper edge of four corner elements (615), to each of which the axle (661) but not the spring biased pin (667) of two perpendicularly oriented frame sections (625) is rotatably mounted, is placed on air-permeable layer (620). Peripheral portion (627) is attached to the entire periphery of a rectangular region (685) of the air-permeable layer, with the exception of its corners, from each of which an angled cutout is formed in order to accommodate the pivoting of the frame sections (625) and the consequent tensioning of the air-permeable layer.

Peripheral portion (627) is illustrated in greater detail in FIG. 30. Peripheral portion (627) is two-ply flexible material stitched together and to edge (696) of air-permeable layer (620). The two-ply material is unstitched from terminal edge (692) of peripheral portion (627) to an intermediate region (695) thereof, to define a loop (694) therebetween. Peripheral portion (627) is stitched to air-permeable layer (620) by any suitable stitching method. The peripheral portion is strong enough to resist detachment therefrom when the air-permeable layer is tensioned.

FIG. 33 illustrates frame contactable portion (622) of air-permeable layer (620). Frame contactable portion (622) protrudes from frame section (625), which overlies the air-permeable layer (620), by a dimension P that takes into account the amount of material needed to be wrapped around outer wall (631), bottom wall (637), and lower inner wall (634) of frame section (625) shown in FIG. 27, as well as the amount of material that is elongated while air-permeable layer (620) is being tensioned during pivoting of the frame sections (625).

With reference also to FIGS. 27, 28, and 30, the peripheral portion (627) of each side of air-permeable layer (620) is then inserted in groove (645) of the corresponding frame section (625) such that its terminal edge (692) contacts, or is substantially in contact with, arcuate wall (647) of the groove so that loop (694) of the peripheral portion will be accessible to aperture (655) of cover member (650). Following insertion of peripheral portion (627) within a corresponding groove (645), rod (698) is used to secure the peripheral portion within the groove. Rod (698), which may be cylindrical, has a thickness equal to, or slightly greater than, the inner diameter of arcuate wall (647) and a length substantially equal to that of upper inner wall (636).

Figure 34:
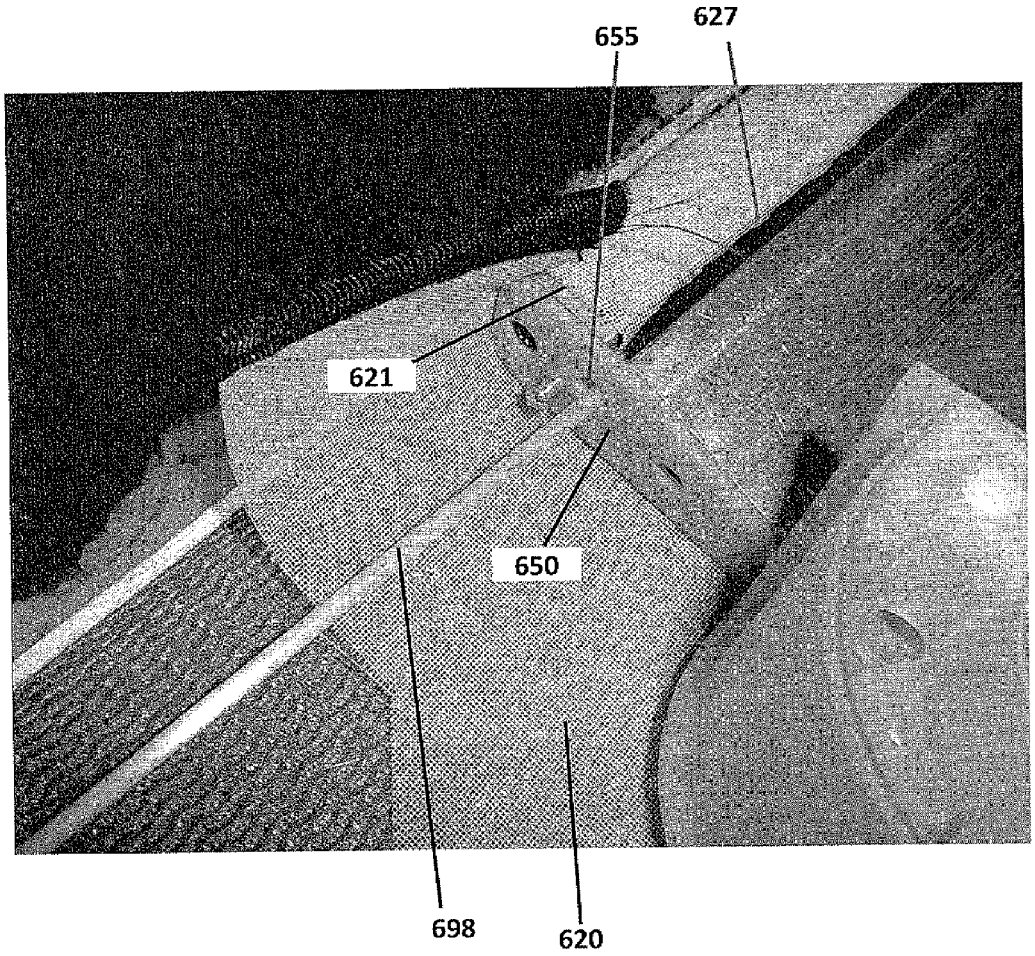
FIG. 34 illustrates a bottom perspective view of a frame section of FIG. 27 in the pre-tensioning position, showing a rod being fed via an aperture of the cover member of FIG. 28 into a peripheral portion of the air-permeable layer in order to be secured to a groove formed in the frame section.

In FIG. 34, rod (698) is shown to be inserted within aperture (655) of cover member (650). Upon longitudinal displacement of rod (698), the latter is fed into the loop of peripheral portion (627). The loop is caused to be expanded by rod (698) and consequently secured to arcuate wall (647) by a pressure fit. Air-permeable layer (620) is cut to form a longitudinal edge (621) thereof in the vicinity of cover member (650).

Figure 36:
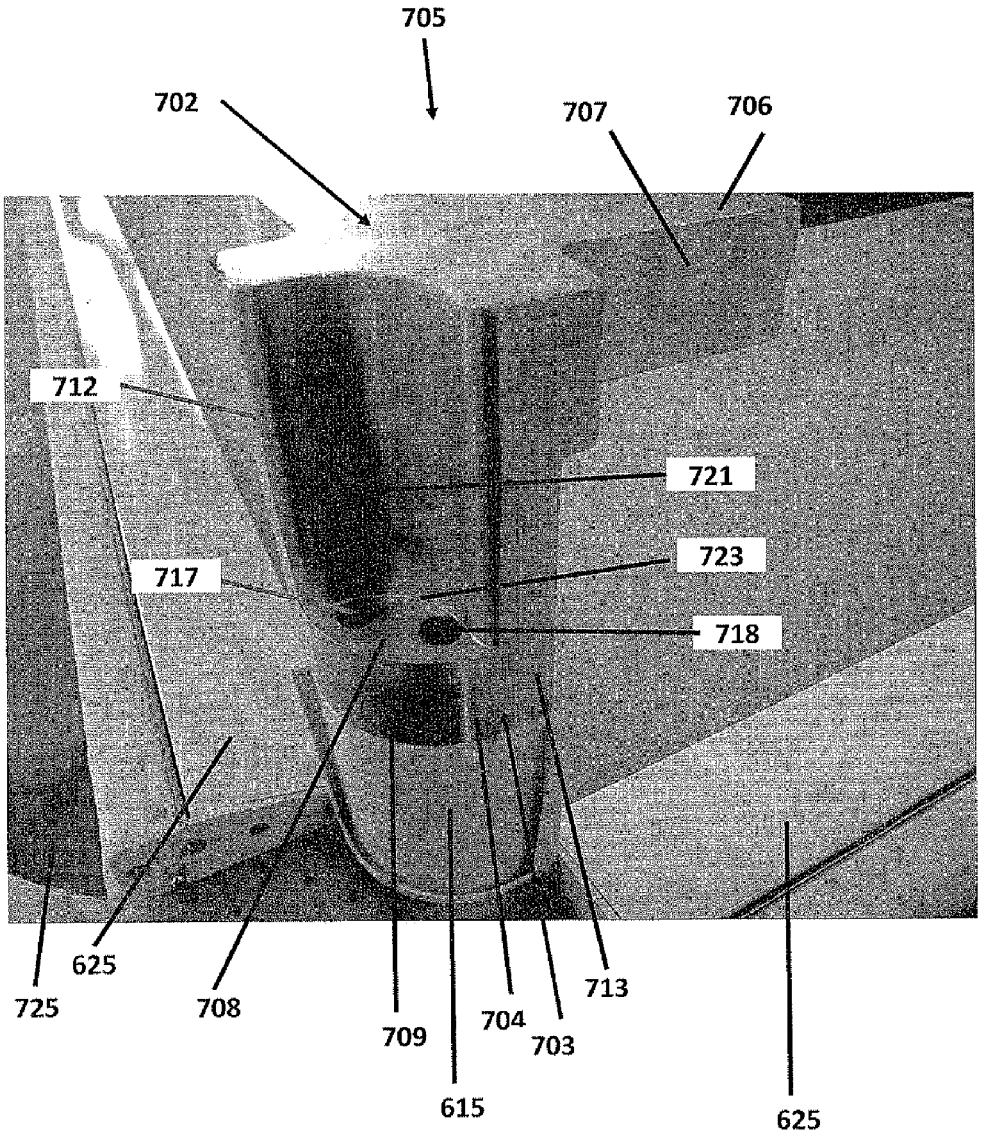
FIG. 36 illustrates a top perspective view of a fixation device coupled to the corner element of FIG. 30.

Frame section (625) is shown to be in a pre-tensioning position in FIG. 35 while its outer wall (631) is substantially parallel to the underlying work surface (725) and frame contactable portion (622) of air-permeable layer (620) is secured thereto. Air-permeable layer (620) is also cut in the vicinity of corner element (615) to form a cross edge (623). Air-permeable layer (620) is ready to be tensioned after each longitudinal edge (621) and cross edge (623) is formed As shown in FIG. 36, a fixation device (705) is used in order to immobilize each corner element (615) while the plurality of frame sections (625) are being pivoted. Fixation device (705) comprises a plurality of unitary connecting members (702), each of which is adapted to be coupled to a corresponding corner element (615), and a plurality of bars (706), e.g. rectangular bars, each of which extends between two adjacent corner elements (615). A connecting member (702) comprises an engagement element (703) contactable with the corresponding corner element (615), a block element (707) to which two bars (706) are connected, and a force applying element (712) vertically extending from block element (707) to engagement element (703). To ensure that a corner element (615) will remain immobilized, each block element (707) is thick and preferably made of metal or any other heavy and rigid material.

With reference also to FIG. 36, an exemplary engagement element (703) is provided with a convex sidewall having a similar curvature as outer wall (674) of corner element (615) and circumferentially extending between interface elements (675) and (676), an upper planar surface (708) substantially perpendicular to sidewall (704), and a planar underside (709) for contacting bottom edge (684) of corner element (615) and abutment plates (671) and (673). Two apertures (717) and (718) are bored in engagement element (703), to allow two respective bolts to be introduced through surface (708) and abutment plates (671) and (673), respectively, and then to be secured to the underlying work surface (725).

Force applying element (712) has a vertical concave surface (721) whose bottom edge (723) borders apertures (717) and (718) as well as sidewall (704). A substantially planar portion (713) vertically extends from sidewall (704) to block element (707), being disposed inwardly from concave surface (721). Since block element (707) is massive, its weight is transmitted to engagement element (703) by means of force applying element (712), causing corner element (615) to be immobilized.

Figure 37:
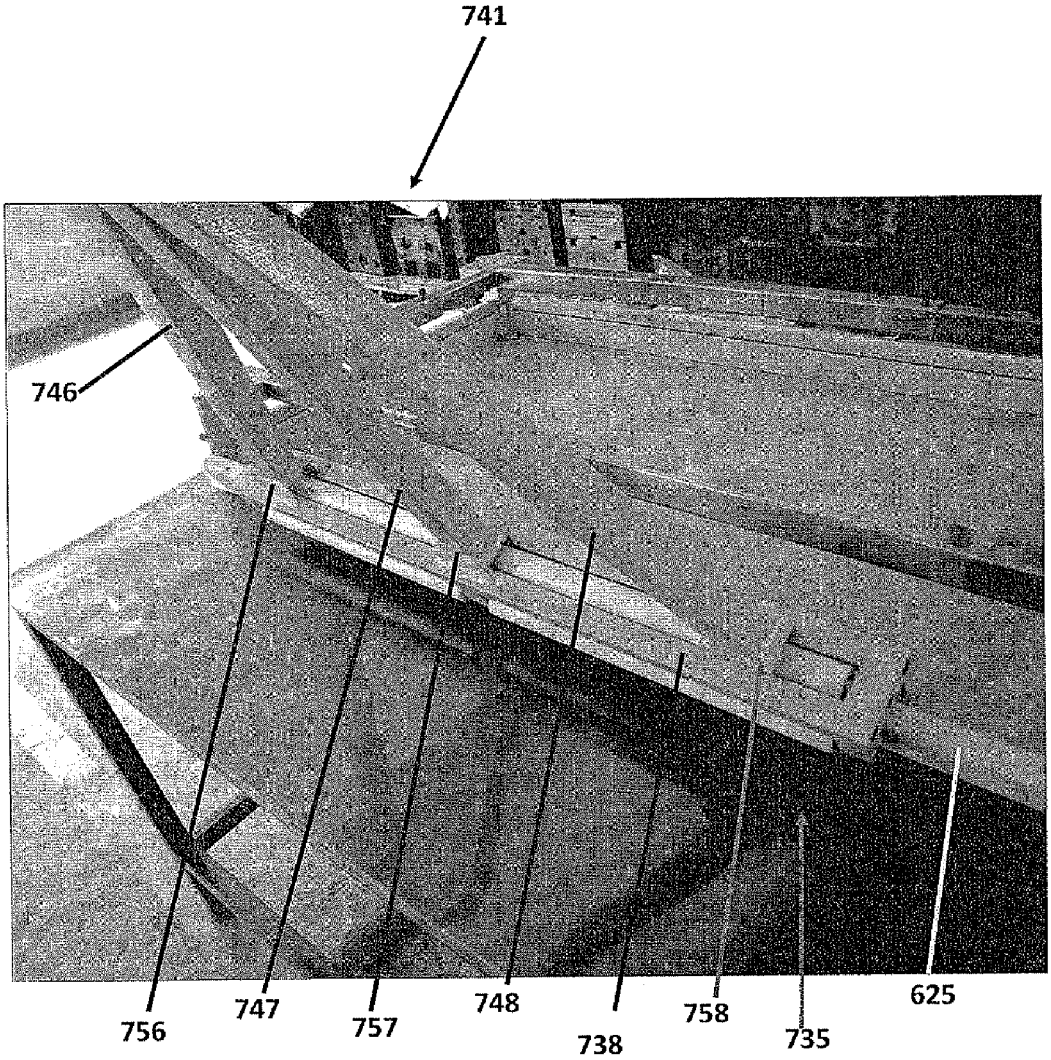
FIG. 37 illustrates a perspective view from the side of an arm assembly effecting the pivoting of the frame section of FIG. 35.
Figure 38:
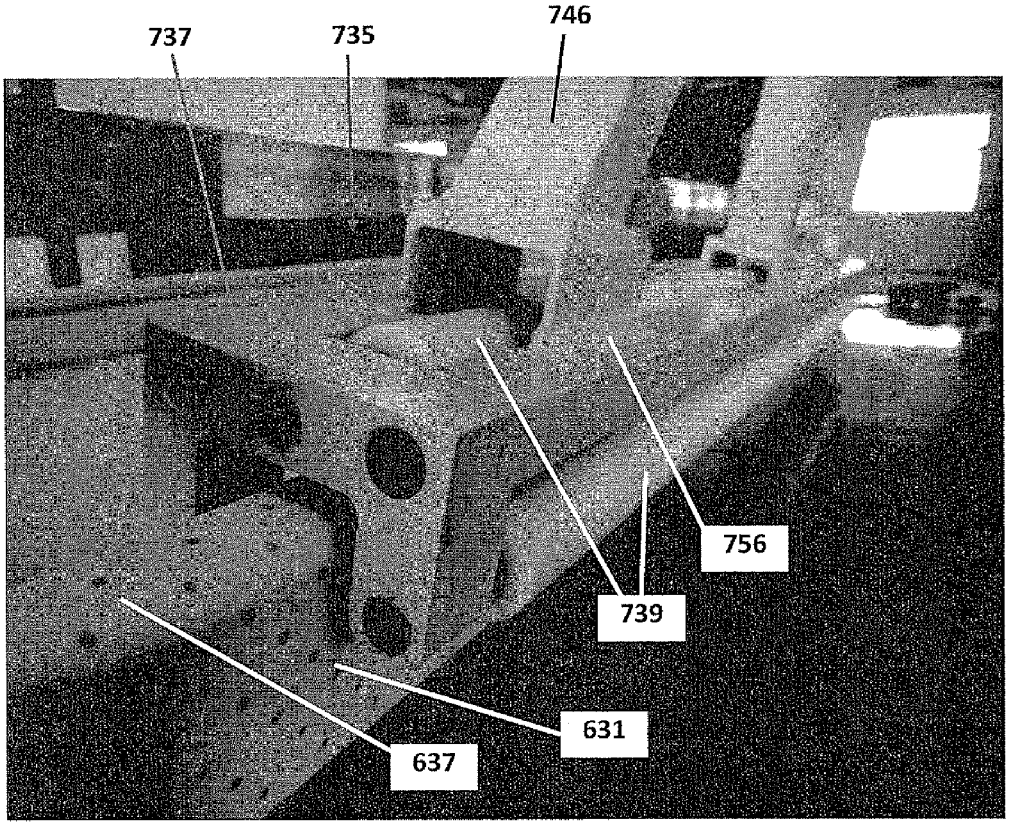
FIG. 38 illustrates a perspective view from the top of a roller assembly connected to the arm assembly of FIG. 37 when the frame section of FIG. 35 is set in an upright position.

In order to pivot a frame section (625) and to thereby cause the air-permeable layer to be tensioned, a roller assembly (735) shown in FIGS. 37 and 38 is brought in pressure contact with a frame section (625) set in the pre-tensioning position. An arm assembly (741) connected to roller assembly (735) is used to transmit a moment applied thereto.

Roller assembly (735) comprises a U-shaped housing (737) in which are rotatably mounted three rollers (739). The three rollers (739) are adapted to rollingly contact outer wall (631) bottom wall (637), and upper inner wall (636) of frame section (625), respectively, to avoid tearing or severing of the air-permeable layer (620) when being tensioned. Each of the rollers (739) may be manually positioned to be in pressure contact with frame section (625), or alternatively, may be automatically positioned, e.g. by means of pneumatically actuated cylinders for displacing a roller to a desired position. The three rollers (739) are placed in sufficiently high pressure contact with frame section (625) such that a force applied to roller assembly (735) will cause frame section (625) to be correspondingly displaced without slip.

Three arms (746), (747) and (748) of arm assembly (741), which may be coplanar, are connected to base (738) of roller assembly housing (737) at different angles. Consequently, arm (746) is connected at region (756) in the vicinity of a first longitudinal end of base (738), arm (748) is connected at region (758) in the vicinity of a second longitudinal end of base (738), and arm (747) is connected at region (757) in the vicinity of an intermediate region of base (738) between regions (756) and (758), while the three arms are connected together at a distance from base (738). Thus a single moment applied to arm assembly (741) may be substantially evenly distributed to regions (756), (757) and (758) so that the air-permeable layer will be evenly tensioned when base (738) is pivoted.

FIG. 37 illustrates frame section (625) as it is being pivoted, and FIG. 38 illustrates frame section (625) in an upright position after being pivoted. In the upright position, the frame contacting portion of the air-permeable layer becomes tensioned after being wrapped about outer wall (631) and bottom wall (637) of frame section (625), causing the sleeping surface of the air-permeable layer to be tensioned as well.

Figure 39:
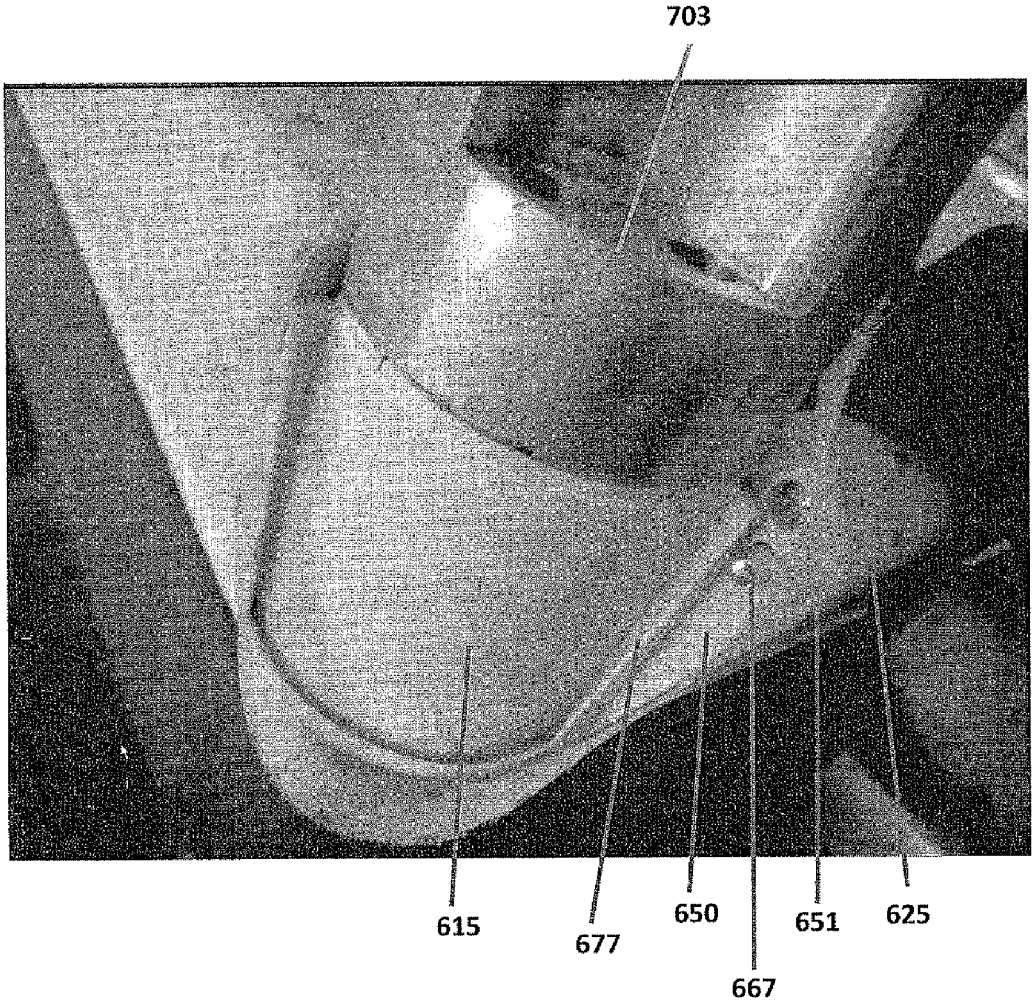
FIG. 39 illustrates a side perspective view of the fixation device of FIG. 36, showing a pin of the frame section of FIG. 35 prior to being engaged with an aperture bored in the corner element of FIG. 29.

FIG. 39 illustrates frame section (625) directly before being set in the upright position. Spring biased pin (667) is shown to be protruding from cover member (650). After frame section (625) is additionally pivoted, pin (667) contacts protruding portion (677) of corner element (615) and is caused to be retracted. When frame section (625) is set in the upright position, pin (667) becomes engaged with aperture (679) shown in FIG. 29, to prevent detachment of frame section (625) from corner element (615). After frame section (625) is set in the upright position, engagement element (703) is separated from corner element (615) and shield (690) shown in FIG. 31 is attached to corner element (615). When shield (690) is attached to corner element (615), additional portions (651) of the air-permeable layer that are not wrapped about frame section (625) will be covered and tensioned by shield (690).

Two or more frame sections (625) may be concurrently pivoted by means of the concurrent displacement of a corresponding number of arm assemblies (741).

One may design a concurrently pivoting mechanism. for the arm assemblies (741) of FIGS. 37 and 38. In a different embodiment, illustrated in FIG. 40*a* and FIG. 40*b*, an exemplary mechanism (800) is used for concurrently pivoting two arm assemblies (802) to provide a uniformly high tensioning of the air-permeable layer. A worktable (805) has four elevated corners (820) to support fixation beams (810), which are attached to corners (615) using the apertures (688) and (689) therein. Two beams (825) extend between two supporting sides of the worktable (805), serving as a solid basis for four arm assemblies (802), one pair of arm assemblies (802) for pivoting the short frame sections (625*a*) and another pair of arm assemblies for the long frame sections (625*b*).

Figure 40A:
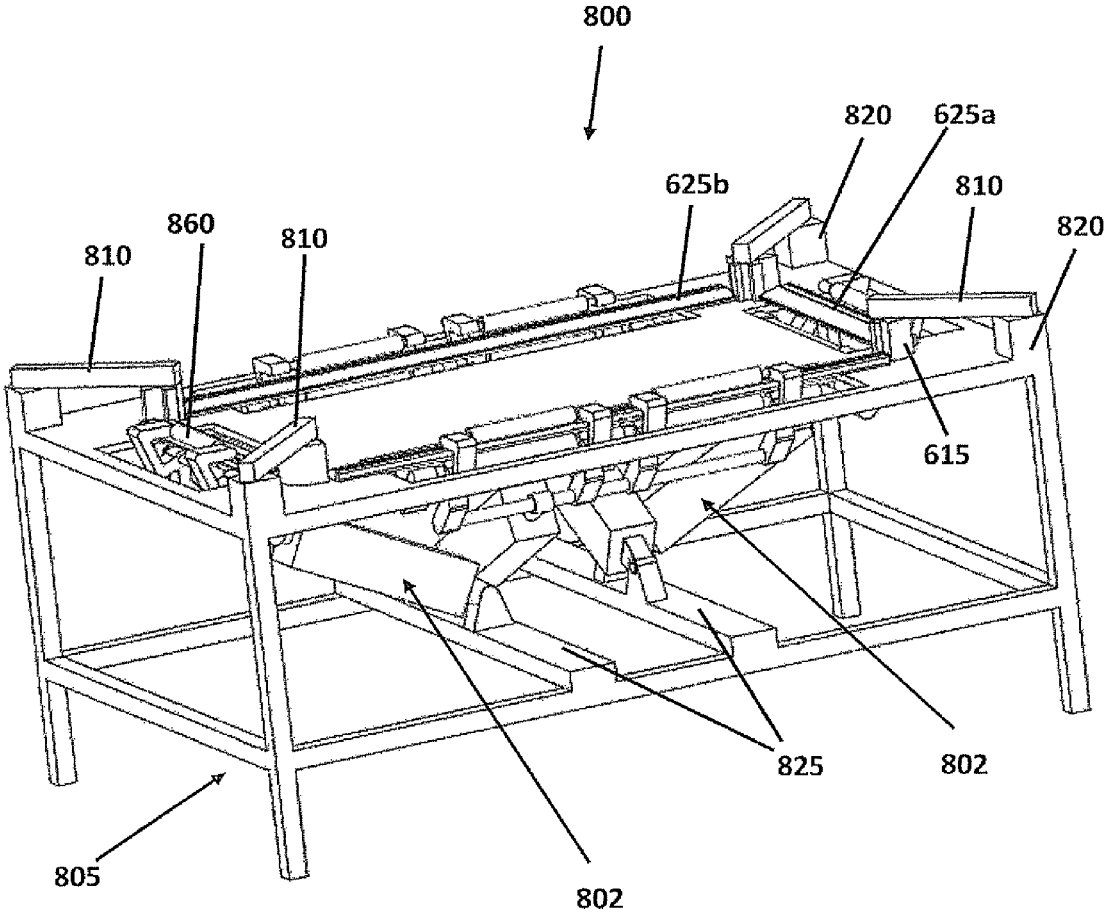
FIG. 40*a* schematically illustrates an exemplary mechanism for concurrently pivoting two arm assemblies of FIG. 37 and to provide a uniformly high tensioning of the air-permeable layer.
Figure 40B:
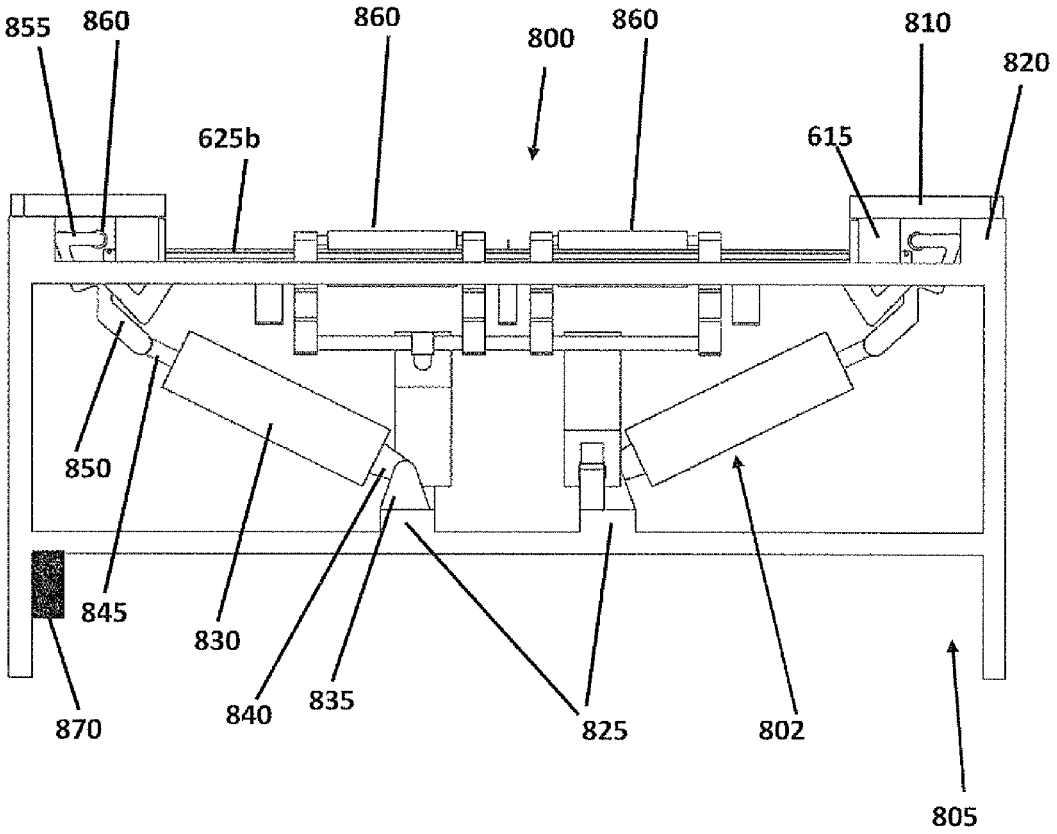
FIG. 40*b* schematically illustrates a controller operable in conjunction with the mechanism of FIG. 40 for selectively controlling the rate of pivoting of a plurality of arm assemblies of FIG. 37.

Referring now to FIG. 40*b*, the four arm assemblies (802) are shown. The arm assembly includes a beam interface (835) pivotably joined by a rod (not shown) to a sleeve base (840), a piston casing (830), a piston (845) pivotably connected to a rod holder (850), and a roller assembly (855) having four rollers (860). The roller assembly (855) holds the respective frame section (625*b*), and outward motion of piston (845) is translated to a pivoting motion of the respective frame section (625*b*) the piston (845) are driven electrically or pneumatically under an electronic control of a controller (870). A single controller (870) may drive the four pistons (845) directly or through a drive unit for each piston. Thus, the pivoting of the two pairs of frame sections (625) may be conducted concurrently, to provide uniform tensioning of the air-permeable layer (620).

The controller (870) may selectively control the operation of two drive units so that the corresponding arm assemblies will pivot at such a rate that the tension of the entire sleeping surface of the air-permeable layer will be tensioned to a substantially uniformly high level. A motion sensor in electrical communication with controller may be operatively connected to two or more pivot members. When a motion related parameter of a pivot member, e.g. angular velocity, is indicative that the tension of one region of the air-permeable layer will be greater than another region, the controller (870) commands one of the drive units to reduce the force applied to the corresponding piston.

Figure 41A:
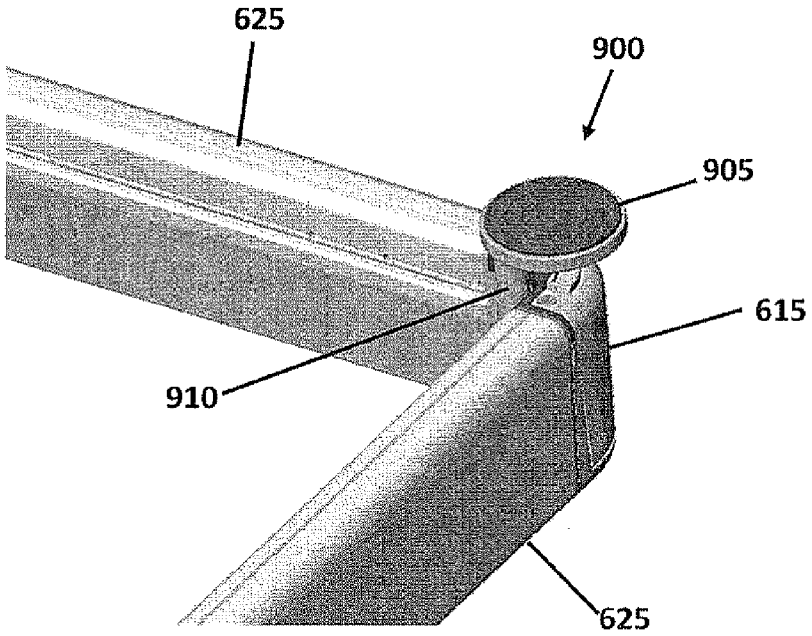
FIG. 41*a* is an isometric view of a surface assembly having a pivotable leg for elevating one longitudinal end of the assembly.
Figure 41B:
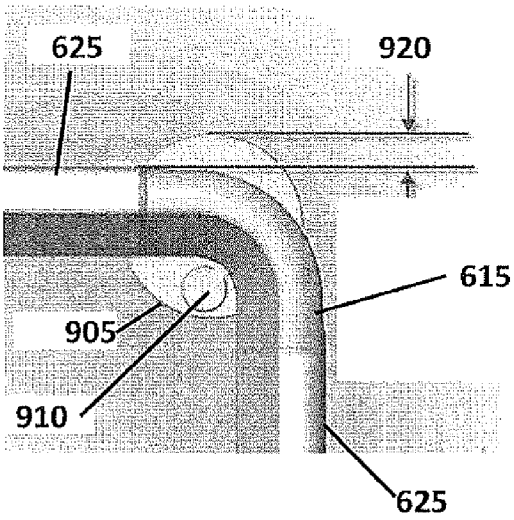
FIG. 41*b* is an upper view of a surface assembly having a pivotable leg for elevating one longitudinal end of the assembly.
Figure 41C:
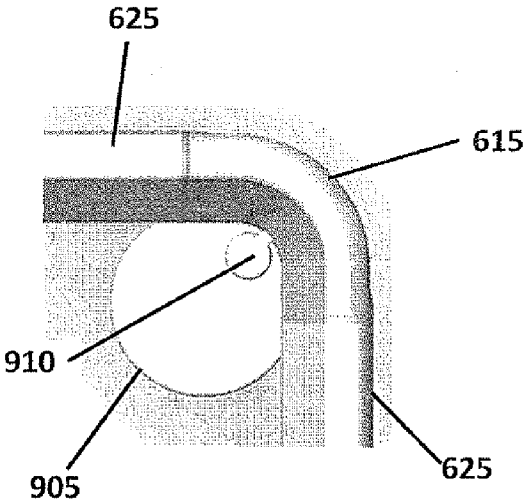
FIG. 41*c* is an upper view of a surface assembly having a pivotable leg of FIGS. 41*a* and 41*b* in a non-active state.

Referring now to FIGS. 41*a*, 41*b*, and 41*c*, a pivotable leg (900) for elevating one longitudinal end of the assembly is shown. The leg (900) includes a base 905 and a post (910), which is pivotably coupled the corner (615). As shown in the upper view of FIG. 41*b*, the leg (900) provides both elevation of the mattress relative to the bed frame, and compensation for a small difference (920) between bed size and respective size of the mattress. In the pivoted state of FIG. 41*c*, the leg base (905) is directed inward for a case no such a compensation is desired.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

EXAMPLES

Several experiments were conducted using the support surface assembly of the present invention to determine the effectiveness of the invention with regard to the health benefits as described herein above.

Example 1

This experiment was performed to determine the amount of dust mites that the support surface assembly of the present invention retains in comparison to a conventional mattress.

*Dermatophagoides farinae* (house dust mites) were cultured in a laboratory using a mixture of horse dander/medical yeast (2:1) at a temperature of 25±1° C. 75±5 relative humidity.

Three support surface assemblies of the present invention, each with a netting of 200 micron (20×20×6×2.8 cm), with 15 strings per cm and 48% open space, were tested and compared with a control (conventional) mattress, the core of which was a polymeric sponge covered with a tissue composed of 50% cotton and 50% polyester (22×22×8 cm), for the survival of mites under optimal environmental conditions.

0.01 mg of mites taken directly from the colony (without medium) (ca. 250-300 mites) and 40 mg of medium were evenly distributed over the entire surface of the support surface assemblies and mattress. Thereafter, the support surface assembly and mattresses were placed in an incubator (24° C. and 70-80% relative humidity). The viability of the mites was examined under a stereo-microscope after 2, 4 and 7 days. On day 7, the support surface assemblies were rinsed thoroughly with distilled water, and thereafter were examined under the stereo-microscope for any remaining mites. Mites were removed from the control mattress surface by shaking it over a container with water. Adhesive bands were glued on the surface of each mattress and the few remaining mites were collected and counted as well. The water with mites and medium from all four support surface assemblies and mattresses was filtered separately through several white filter papers (Schleicher & Schuell, 604, 7 cm diameter), and the number of live mites was counted under a stereo-microscope (5×).

The results of this experiment, showing the mite survival during the two days of experiment are displayed in Table 1, in FIG. 19. After days 2 and 4, very few (+) or few + mites were detected on the support surface assemblies (I, J, K), and a lot ++ of mites were detected on the control mattress (C). After day 7, all three support surface assemblies had very few mites, with an average of 26.3 mites between them. The control mattress contained a lot of mites, estimated at 490.

The few mites seen on the support surface assemblies were mainly concentrated at the edges of the mattress where the food and mites could survive between the wood and netting. The distance between fibers was large enough to prevent mites and medium from remaining on the surface. On the control mattress, mites were apparently behaving normally (laying eggs, copulating, eating). 30 times fewer mites could be found on the support surface assembly of the present invention than on the control mattress after 2 days of experimentation.

Example 2

Four experiments were performed to determine whether the circulation through the support surface assembly of the present invention is sufficient to allow $CO_2$ gathered above it to flow through it.

Three support surface assemblies were used. A first support surface assembly was not covered, a second support surface assembly was covered by a unique netted sheet, and a third support surface assembly was covered by a conventional linen sheet.

$CO_2$ was pumped from a tank through a tube at a rate and volume that simulated the breathing of 6 month old infant. The tank contained air having 5% $CO_2$ such that the maximum amount of $CO_2$ in the pumped mixture could be 5%, which is exemplary of an infant's breath.

First, a control experiment was performed were a container was positioned on top of the uncovered mattress, and a seal hermetically sealed the mattress from below. $CO_2$ was pumped into the container until a maximum of 5% $CO_2$ filled the container. This experiment was performed as a control to determine how long it would take to fill the container with 5% of $CO_2$.

Next, the seal from below the mattress was removed, and $CO_2$ was pumped into the container situated above each of the three test mattresses.

Figure 20:
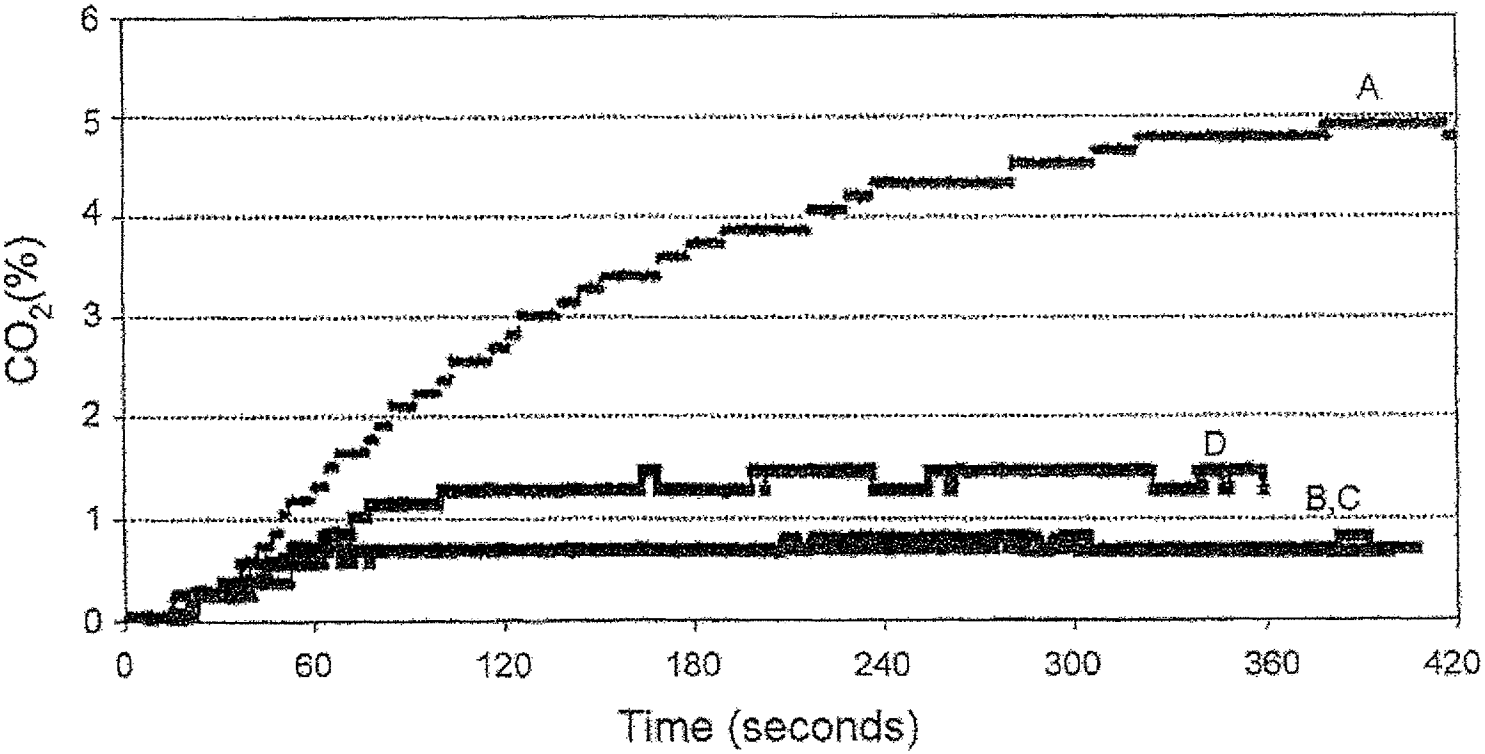
FIG. 20 illustrates the results of the second example, for determining the ability of the invention to prevent $CO_2$ accumulation.

The results of each of the experiments are presented graphically in FIG. 20. The top curve, marked "A" indicates the results of the first, control experiment. As can be seen, after slightly more than six minutes, the entire container is filled with 5% of $CO_2$. The curves marked "B" and "C" indicate the amount of $CO_2$ accumulated within the container above the uncovered support surface assembly ("B") and the support surface assembly covered with the netted sheet ("C"). As can be seen, after six minutes, less than 1% of $CO_2$ accumulated in the container. Finally, curve "D" indicates that a maximum of approximately 1.5% $CO_2$ accumulated in the container above the support surface assembly covered by the conventional linen sheet.

The results show that the airflow through the uncovered support surface assembly, and through the support surface assembly covered with the netted cover, are essentially the same, and allow almost the entire amount of $CO_2$ to pass through. The support surface assembly covered with a conventional linen sheet prevents a little more $CO_2$ from passing through, but still, the level of retained $CO_2$ is low.

Figure 42:
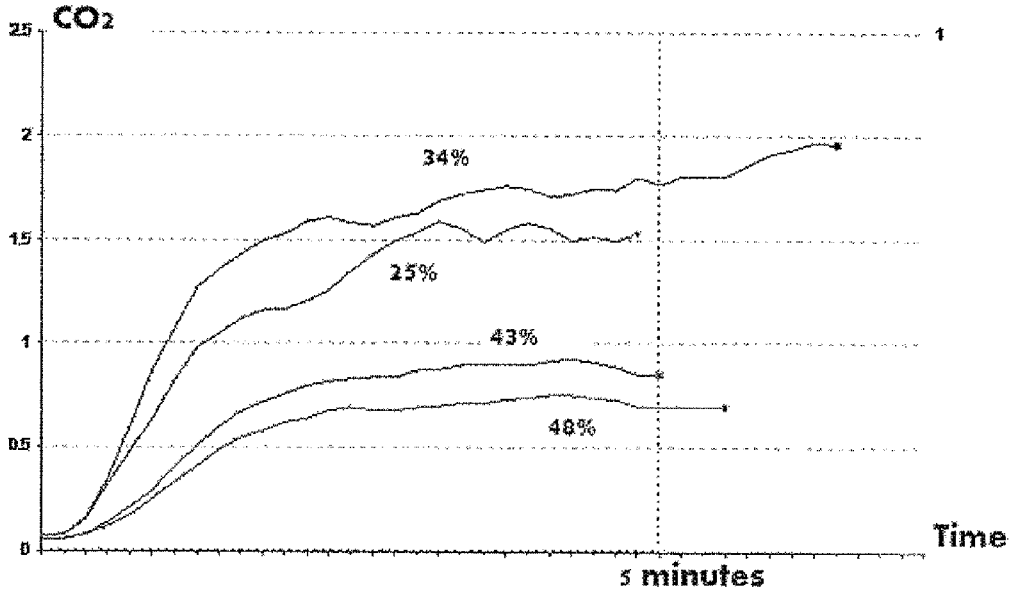
FIG. 42 presents $CO_2$ accumulation (%) in head box as function of elapsed time (minutes) with fiber to area ratio as a parameter, for 25%, 34%, 43% and 48% parameter values.

Later experiments compared ventilation properties of nets having different space to fiber ratios. The experiments were done in a hospital pulmonary laboratory, and an AirNettress® mattress of Lizron, The Child Development Company, Pardes-Hana, Israel, was used. The mattress is made of a polyester net (Sefar AG Filtration Solutions, Heiden, Switzerland) which is stretched over a wooden or aluminum frame. The net was made of 200 micron diameter fibers at a density of 15 fibers/cm, which attains a space to fiber ratio of approximately 1:1 (48%—fiber to area ratio), as well as nets having lower fiber to area ratios, 43%, 34% and 25%. A head box was placed with its open face on the mattress and connected with tubing to a gas reservoir filled with 7% $CO_2$. The 7% $CO_2$ mixture flowed into the head box at a rate of 1.5 Liter/minute (L/m). The rate of $CO_2$ accumulation in the head box was measured at 10 second intervals for at least 5 minutes. The nets with fiber to area ratios of 43% and 48% exhibited significantly lower tendencies towards $CO_2$ accumulation (under 1% $CO_2$) than the nets with fiber to area ratios of 34% and 25%, (over 1.5% $CO_2$), as shown in FIG. 42.

To conclude, significant rebreathing of $CO_2$ may be prevented by use of a netted surface with a fiber to area ratio of above 40%. Note that $CO_2$ levels below 1% are considered safe environmental conditions according to NIOSH guidelines, DHHS Publication No. 76-194, august 1976.

Example 3

The Standards Institution of Israel, Tel Aviv, conducted several tests to determine various parameters of the air-permeable layer. The sample that was tested had a thickness of 200 microns, a warp and weft mesh count of 15.0/cm. After 500 pressing operations, the sample was shown not to sag at all. After 1000 pressing operations, the sample was shown to slightly sag. After 2000 pressing operations, the sample was shown to sag 2 mm at the point of impact.

The tensile strength of the sample was tested. The sample was shown to have a lengthwise tensile strength of 1374 N, a widthwise tensile strength of 1031 N, a lengthwise elongation of 21%, and a widthwise elongation of 34%.

Example 4

The laboratory division of Sefar AG, Thal, Switzerland, conducted an elasticity test on a sample of PET 1000 15-200 W PW screenprinting mesh. The sample that was tested had a thickness of 200 microns, a warp and weft mesh count of 15.0/cm.

The sample was overnight and then during the daytime was not tensioned. The tension of the sample was measured at night and during the daytime. The test was repeated three times. Here are the results:

TABLE III

| Test Period | Elongation Warp (%) | Elongation Weft (%) |
|---|---|---|
| Monday evening, tensioned | 1.0 | 0.5 |
| Tuesday morning, non-tensioned | 0 | 0 |

TABLE III-continued

| Test Period | Elongation Warp (%) | Elongation Weft (%) |
|---|---|---|
| Tuesday evening, tensioned | 1.0 | 0.5 |
| Wednesday morning, non-tensioned | 0 | 0 |
| Wednesday evening, tensioned | 1.1 | 0.5 |
| Thursday morning, non-tensioned | 0.3 | 0.2 |
| Thursday evening, tensioned | 1.3 | 0.6 |
| Friday morning, non-tensioned | 0.5 | 0.2 |

Example 6

The Japan Food Hygiene Association, Tokyo, conduction various tests on a white UX-SCREEN. The sample was shown to pass the material test with respect to cadmium and lead, the dissolution test with respect to heavy metals, consumption of potassium permanganate, antimony and germanium, and the residue on evaporation after dissolution test with the solvents of n-heptane, 20% ethanol, water, and 4% acetic acid.

CONCLUSION

The experimental results show that the present invention provides a safe support surface assembly for sleeping thereon, particularly for infants and those suffering from allergies, and enables effortless breathing through it.

The invention claimed is:

1. A support surface assembly for a sleeping person, said assembly comprising:

a. four corner elements;

b. four elongated, rigid frame sections defining a rectangular perimeter of said support surface assembly, each of said frame sections is provided with an upper edge, inner wall, and outer wall, wherein two adjacent and substantially mutually perpendicular frame sections are pivotally connected to a common corner element; and c. an air-permeable layer suspended on the upper edge of said frame sections, a plurality of peripheral portions being attached to said air-permeable layer, wherein each peripheral portion of the air-permeable layer is secured to a corresponding frame section, a frame contactable portion of the air-permeable layer being wrapped about said corresponding frame section upon application of a moment to each of said corresponding frame sections, whereby to tension said air-permeable layer and cause said corresponding frame sections to be coupled with two adjacent corner elements;

wherein each of the two adjacent corner elements has a convex outer wall and an arcuate inner wall both of which subtending an angle of approximately 90 degrees, and two straight interface elements extending between said outer wall and said inner wall at each terminal end thereof, two apertures being bored in each of said interface elements by which a corresponding frame section is coupled with one of the two adjacent corner elements; and wherein the frame section has a cover member with a planar plate at each of its two longitudinal ends facing an adjacent one of the two adjacent corner elements, an axle by which the frame section pivots and a spring biased pin protruding from said cover member for engaging the two apertures, respectively, bored in an adjacent interface element of one of the two adjacent corner elements.

2. The support surface assembly of claim 1, wherein each peripheral portion of the air-permeable layer is received and secured by means of a pressure fit in a groove formed in the inner wall of a corresponding frame section.

3. The support surface assembly according to claim 1, wherein the air-permeable layer is a screenprinting mesh, and the mesh is fatigue resistant during 2000 pressure applications at a level of 10 N/100 $cm^2$.

4. The support surface assembly according to claim 1, wherein each peripheral portion of the air-permeable layer is received and secured by means of a pressure fit in a groove formed in the inner wall of a corresponding frame section, and the groove is a longitudinally extending groove that separates an inner wall of the frame section into an upper inner wall and a lower inner wall.

5. The support surface assembly according to claim 4, wherein the frame section has a planar outer wall and a bottom wall substantially perpendicular to the outer wall and to a lower inner wall, said bottom wall being provided with two opposed rounded portions extending to said planar outer wall and said lower inner wall, respectively.

6. The support surface assembly according to claim 5, wherein an upper wall of a frame section is oblique with respect to the outer wall such the width of an upper edge which extends between the outer wall and an upper inner wall is considerably less than width of the bottom wall.

7. The support surface assembly according to claim 6, wherein the width of the upper edge is in the range of 8 to 15 mm, and the width of the bottom wall is in the range of 30 to 50 mm.

8. The support surface assembly according to claim 4, wherein the peripheral portion is attached to the air-permeable layer and comprises a loop for receiving via an opening in the cover member a rod securable to walls of the groove.

9. The support surface assembly according to claim 1, wherein the corner element is provided with an interspace between the inner and outer walls through which attachment elements for immobilizing the corner element by means of a fixation device and for attachment to an underlying work surface pass.

10. The support surface assembly according to claim 1, further comprising a decorative shield contactable with, and securable to, the outer wall of the corner element, an outer wall of an adjacent frame section being substantially flush with said shield after being pivoted to an upright position.

11. The support surface assembly according to claim 1, further comprising at least one transverse cross bar extending transversely between opposite frame sections.

12. The support surface assembly according to claim 1, wherein vibratory motion of the air-permeable layer is transmitted to a movement sensor placed on a stationary frame support by means of a vibration transmitter.

13. The support surface assembly according to claim 12, wherein the vibration transmitter comprises an upper member in contact with an underside of the air-permeable layer, a lower member in contact with the movement sensor and coupled to said upper member, and spring means extending from said lower member to a surface of said upper member, said lower member adapted to oscillate in response to the vibratory motion, whereby to induce a corresponding electrical signal by means of the movement sensor.

14. The support surface assembly according to claim 13, wherein a portion of an upper member body surrounds a lower member body and the lower member is coupled with the upper member by means of one or more pins protruding from the side of the lower member body and received in a corresponding vertically oriented groove formed in the upper member body.

15. The support surface assembly according to claim 13, wherein the spring means is a stiff coiled spring by which the upper and lower members are vertically displaced in unison in response to the vibratory motion.

16. The support surface assembly according to claim 13, wherein the upper member has a flange for contacting the air-permeable layer, said flange being made of, or covered by, a resilient material for protecting a person located on the air-permeable layer.

17. The support surface assembly according to claim 1, further comprising a plurality of pivotable legs for elevating one longitudinal end of the assembly.

18. The support surface assembly of claim 1 wherein a final length of the air-permeable layer stretched over a distance between groove centers after pivoting the frame sections is 1-4% longer than the initial length of the air-permeable layer stretched over a distance between groove centers before pivoting.

19. The support surface assembly of claim 1 wherein the sleeping surface is tensioned to a level greater than 650 kg in a long direction of the assembly and to a level greater than 350 kg in a short direction thereon.

20. The support surface assembly of claim 1 wherein the air-permeable layer has a ratio of fiber to area between 40% and 60%.

21. The support surface assembly of claim 20 wherein the air-permeable layer has a ratio of fiber to area between 45% and 55%.

* * * * *